US007798371B2

(12) United States Patent
Ophardt

(10) Patent No.: US 7,798,371 B2
(45) Date of Patent: Sep. 21, 2010

(54) ARCUATE TO LINEAR MOTION TRANSLATION ASSEMBLY

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 529 days.

(21) Appl. No.: 11/976,604

(22) Filed: Oct. 25, 2007

(65) Prior Publication Data

US 2008/0121659 A1 May 29, 2008

(30) Foreign Application Priority Data

Nov. 29, 2006 (CA) ..... 2569194

(51) Int. Cl.
*B67D 7/06* (2010.01)

(52) U.S. Cl. ..... 222/181.3; 222/182; 222/321.8; 222/325

(58) Field of Classification Search ..... 222/180, 222/181.1–181.3, 182, 183, 321.7–321.8, 222/322–327, 505–509, 511–518, 526, 533
See application file for complete search history.

(56) References Cited

U.S. PATENT DOCUMENTS 4,978,036 A * 12/1990 Burd ..... 222/207
5,431,309 A * 7/1995 Ophardt ..... 222/181.3
5,445,288 A * 8/1995 Banks ..... 222/95
5,638,989 A * 6/1997 Ophardt et al. ..... 222/105
6,305,580 B1 * 10/2001 Chen ..... 222/162
2005/0247737 A1 * 11/2005 Armstrong ..... 222/214

* cited by examiner

*Primary Examiner*—Kevin P Shaver
*Assistant Examiner*—Andrew P Bainbridge
(74) *Attorney, Agent, or Firm*—Riches, McKenzie & Herbert LLP

(57) ABSTRACT

A simplified arrangement for the translation of movement as, for example, arcuate movement as from a lever into movement which is different as for example, in a linear direction with a slide element preferably comprising a piston in a piston pump. In accordance with a preferred aspect, the present invention provides a bridging element which is disposed intermediate a pivoting lever and a linearly sliding slide element with the bridging member being retained in engagement with camming surfaces having an arcuate portion at a constant distance from the pivot axis of the lever and tangentially merging into a linear portion which is parallel to a longitudinal axis along which the slide element is slidable. The bridging member is slidable relative to the camming surface with the bridging member deforming to assume the shape of the camming surface where the bridge member engages the camming surface. Movement of the lever about the pivot axis moves a first end of the bridge member in an arcuate path where it engages the arcuate portion of the camming surfaces and moves a second end of the bridging member connected to the slide element in a linear direction along the linear portion of the camming surfaces.

21 Claims, 17 Drawing Sheets

ARCUATE TO LINEAR MOTION TRANSLATION ASSEMBLY

SCOPE OF THE INVENTION

This invention relates to an arrangement for translating arcuate motion to linear motion and, more particularly, to an arrangement for translation of the arcuate movement of a lever to linearly move an element, such as a piston, in a piston pump for dispensing fluids.

BACKGROUND OF THE INVENTION

Devices are known in which arcuate, pivoting motion of a lever is applied to a slide element which is slidable in a straight linear path. For example, in many fluid dispensers, such as the type disclosed in U.S. Pat. No. 5,431,309 to Ophardt, issued Jul. 11, 1995, the arcuate pivoting movement of a manually operated lever is used to move a piston element of a piston pump coaxially linearly within a piston chamber forming member. One disadvantage of such previously known dispensers is that forces are applied to the piston element of the piston pump which are not merely axially directed resulting in the engagement between the piston element and the piston chamber forming member being required to resist such non-axially directed forces often leading to leakage and failure of the pump. Another disadvantage of such previously known devices is that to avoid pump failure separate mechanical arrangements must be provided to independently guide the piston element of the pump to only move linearly separate from the engagement of the piston element in the piston chamber.

SUMMARY OF THE INVENTION

To at least partially overcome these disadvantages of previously known devices, the present invention provides a simplified arrangement for the translation of movement as, for example, arcuate movement as from a lever into movement which is different as for example, in a linear direction with a slide element preferably comprising a piston in a piston pump. In accordance with a preferred aspect, the present invention provides a bridging element which is disposed intermediate a pivoting lever and a linearly sliding slide element with the bridging member being retained in engagement with camming surfaces having an arcuate portion at a constant distance from the pivot axis of the lever and tangentially merging into a linear portion which is parallel to a longitudinal axis along which the slide element is slidable. The bridging member is slidable relative to the camming surface with the bridging member deforming to assume the shape of the camming surface where the bridge member engages the camming surface. Movement of the lever about the pivot axis moves a first end of the bridge member in an arcuate path where it engages the arcuate portion of the camming surfaces and moves a second end of the bridging member connected to the slide element in a linear direction along the linear portion of the camming surfaces.

The motion translation assembly of the present invention facilitates providing for linear movement of the slide element over greater distances as can be advantageous to provide increased stroke for piston element movement especially in foam dispensing pumps in which increased volumes of air leading to increased flow velocities can be advantageous.

An object of the present invention is to provide an inexpensive motion translation arrangement for translating the arcuate motion of a lever into sliding motion of a slide member.

Another object is to provide a simplified arrangement for linear movement of a piston element of a piston pump via a manually engageable lever.

In one aspect, the present invention provides a dispenser comprising:

a housing, a dispensing mechanism including a slide element mounted to the housing for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having an outer camming surface extending from a first end to a second end, the outer camming surface having an arcuate portion and a linear portion, the arcuate portion extending from the first end to where it merges into the linear portion, the linear portion extending from the arcuate portion to the second end, over the arcuate portion the outer camming surface disposed at a constant radius from the pivot axis, over the linear portion the outer camming surface being parallel to the longitudinal axis and directed to intersect with the slide element, the outer camming surface over the linear portion comprising a tangential extension of the outer camming surface where the arcuate portion merges with the linear portion, a bridge member having a first end, a second end, a first side edge, a second side edge, and an outer camming surface, the bridge member coupled to the housing between the slide element and the lever with the first end of the bridge member engaging the lever, the second end of the bridge member engaging the element, and the outer cammed face of the bridge member urged into sliding engagement with the outer camming surface of the housing such that the bridge member between its first end and second end is deformed to assume the shape of the camming surface of the housing where the cammed face of the bridge member engages the camming surface of the housing, the bridge member slidable with the outer cammed face of the bridge member in engagement with the outer camming surface of the housing between: (a) a first position in which the slide element is in the extended position, the lever is in a first rotational position relative the pivot axis and the outer cammed face is entirely engaged with the linear portion of the outer camming surface and, (b) a second position in which the slide element is in the retracted position, the lever is in a second rotational position rotated from the first rotational position about the pivot axis, and the outer cammed face is entirely engaged with the arcuate portion of the outer camming surface.

In another aspect, the present invention a dispenser comprising:

a housing, a dispensing mechanism including a slide element mounted for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having a pair of spaced first and second side walls on either side of the element, each side wall generally disposed in a plane normal to the pivot axis, each side wall having a slotway defined between an inner camming surface and an outer camming surface extending in the plane of its respective side wall from a first end of the slotway to a second end of the slotway, each slotway being parallel to the other slotway, each slotway having a constant width between the between the inner camming surface and the outer camming surface, each slotway having an arcuate portion and a linear portion, the arcuate portion extending from the first end to where it merges into the linear portion, the linear portion extending tangentially from the arcuate portion to the second end, in the arcuate portion the inner camming surface is disposed at a first radius from the pivot axis and the outer camming surface disposed at a second radius from the pivot axis greater than the first radius, in the linear portion the inner camming surface and the outer camming surface are straight and linear and each extends parallel to the longitudinal axis, the inner camming surface over the linear portion comprising a tangential extension of the inner camming surface where the arcuate portion merges with the linear portion, the inner camming surface over the linear portion being parallel to the longitudinal axis, the outer camming surface over the linear portion comprising a tangential extension of the outer camming surface where the arcuate portion merges with the linear portion, the outer camming surface over the linear portion being parallel to the longitudinal axis, a bridge member comprising a planar member having a first face, a second face, a first end, a second end, a first side edge and a second side edge, the bridge member spanning between the side walls of the housing with portions of the bridge member proximate the first side edge received in the slotway of the first side wall for longitudinal sliding in the slotway of the first side wall and with portions of the bridge member proximate the second side edge received in the slotway of the second side wall for longitudinal sliding in the slotway of the second side wall, the bridge member longitudinally slidable in each slotway between: (a) a first position in which the first end of the bridge member is in the arcuate portion of the slotways proximate the first end of the slotways and the second end of the bridge member is in the slotways spaced towards the second end of the slotways from the first end of the bridge member, and (b) a second position in which the second end of the bridge member is in the linear portion proximate the second end of the slotways and the first end of the bridge member is in the slotways spaced towards the first end of the slotways from the second end of the bridge member, in moving from the first position to the second position, flexible portions of the bridge member moving from being within the arcuate portions of the slotways to being within the linear portions of the slotway, and in moving from the second position to the first position, the flexible portions of the bridge member moving from being within the linear portions of the slotways to being within the arcuate portions of the slotway, the flexible portions of the bridge member conforming to the shape of the section of the slotway in which it is disposed in by engagement between the inner surfaces of the slotways with the first face the bridge member and/or by engagement between the outer surfaces of the slotways with the second face the bridge member, the first end of the bridge member engaging the lever at a location on the lever at a distance from the pivot axis at or between the first radius and the second radius, the second end of the bridge member engaging the slide element, wherein: (i) movement of the lever member pivotally about a pivot axis in a first rotational direction slides the first end of the bridge member in the arcuate portions of the slotway and slides the second end of the bridge member in the linear portion of the slotways applying forces substantially merely parallel to the longitudinal axis to the slide element to move the slide element linearly to a first of the extended position and the retracted position, and (ii) movement of the lever member pivotally about a pivot axis in a second rotational direction opposite to the first rotational direction slides the first end of the bridge member in the arcuate portions of the slotway and slides the second end of the bridge member in the linear portion of the slotways applying forces merely parallel to the longitudinal axis to the slide element to move the slide element linearly to the other of the extended position and the retracted position.

In another aspect, the present invention provides a dispenser comprising:

a housing, a dispensing mechanism including a slide element mounted to the housing for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having a camming surface disposed at a constant radius from the pivot axis, a flexible bridge member having a first end, a second end, a first side edge, a second side edge, and a cammed face, the bridge member coupled to the housing between the slide element and the lever with the first end of the bridge member engaging the lever, the second end of the bridge member engaging the element, and the cammed face of the bridge member urged into sliding engagement with the camming surface of the housing such that the bridge member between its first end and second end is deformed to assume the shape of the camming surface of the housing where the cammed face of the bridge member engages the camming surface of the housing, the bridge member slidable with the cammed face of the bridge member in engagement with the camming surface of the housing between: (a) a first position in which the slide element is in the extended position and the lever is in a first rotational position relative the pivot axis and, (b) a second position in which the slide element is in the retracted position and the lever is in a second rotational position rotated from the first rotational position about the pivot axis.

BRIEF DESCRIPTION OF THE DRAWINGS

Further objects and advantages of the invention will appear from the following description taken together with the accompanying drawings in which.

DETAILED DESCRIPTION OF THE DRAWINGS

Figure 1:
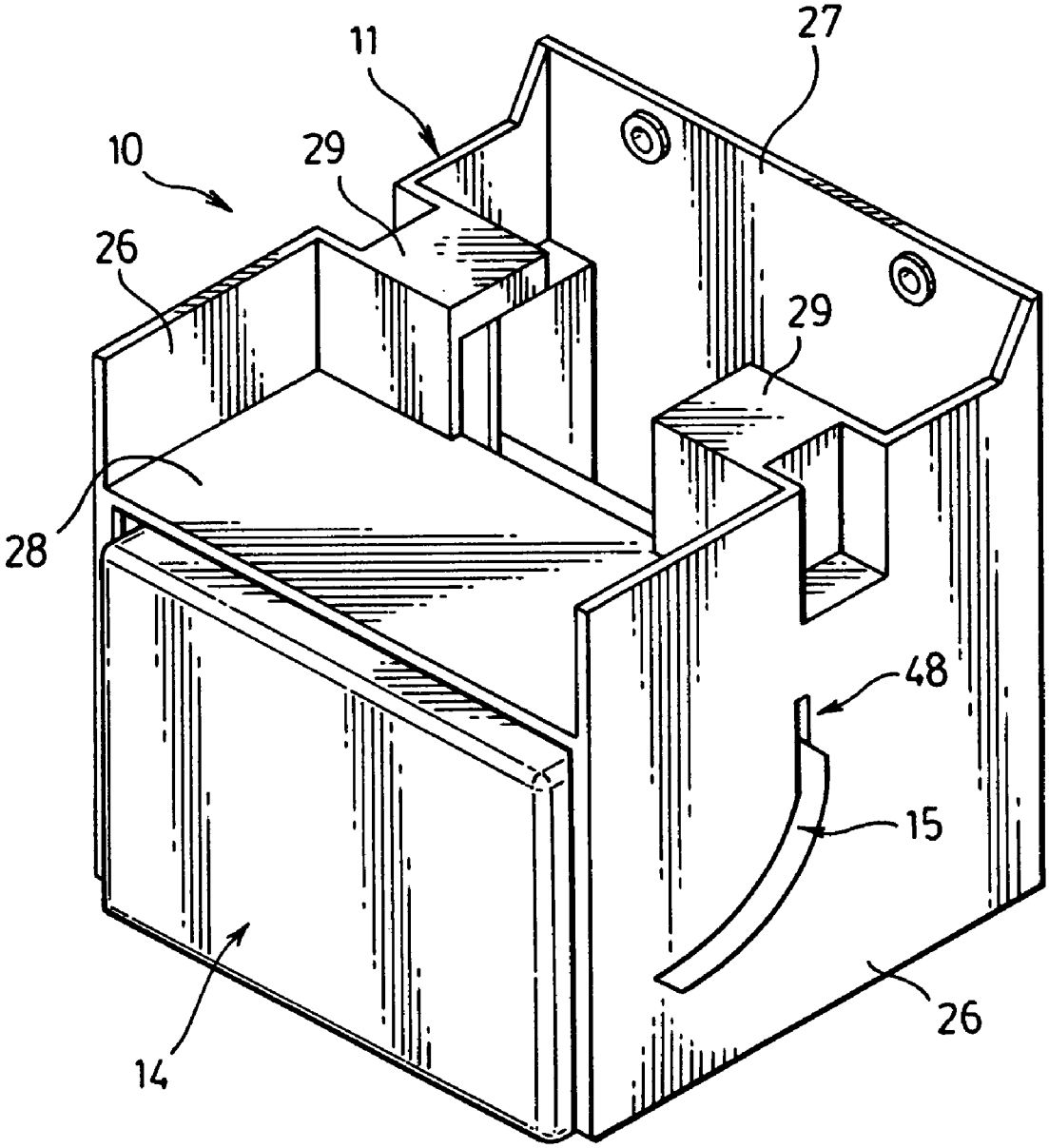
FIG. 1 is a perspective view of a motion translation assembly in accordance with a first embodiment of this invention.
Figure 2:
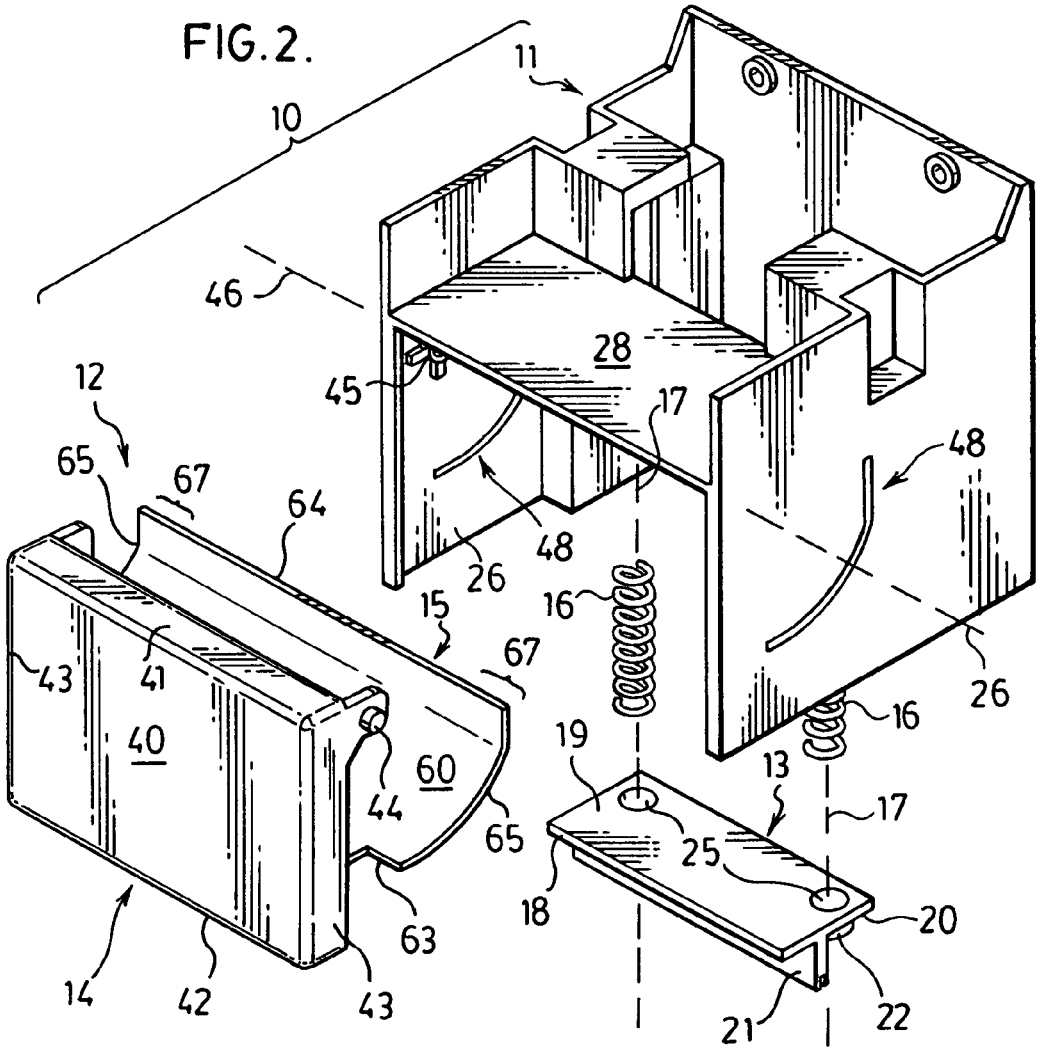
FIG. 2 is an exploded view of the assembly of FIG. 1.

Reference is made first to FIGS. 1 to 7 showing a first embodiment of a motion translation assembly 10 of the present invention. The motion translation assembly 10 includes a housing 11 and an actuator assembly 12 movable relative to the housing 11. The actuator assembly 12 includes a slide element 13, a lever 14 and a bridge member 15 connecting the slide element 13 to the lever 14. Springs 16 are provided to bias the slide element 13 away from the housing 11. The slide element 13 is coupled to the housing 11 for linear movement about a straight longitudinal axis 17 relative to the housing 11 which axis is shown to be vertical in the figures. The slide element 13 includes an upper plate 18 with an upper surface 19 and a lower surface 20. An engagement flange 21 and a reinforcing rib 22 extend downwardly from the lower surface 20. The engagement flange 21 extends downwardly to a distal end 23 carrying a downwardly opening channelway 24. A pair of circular openings 25 extend downwardly through the plate 18 with portions of the rib 22 coaxially thereabout.

Figure 3:
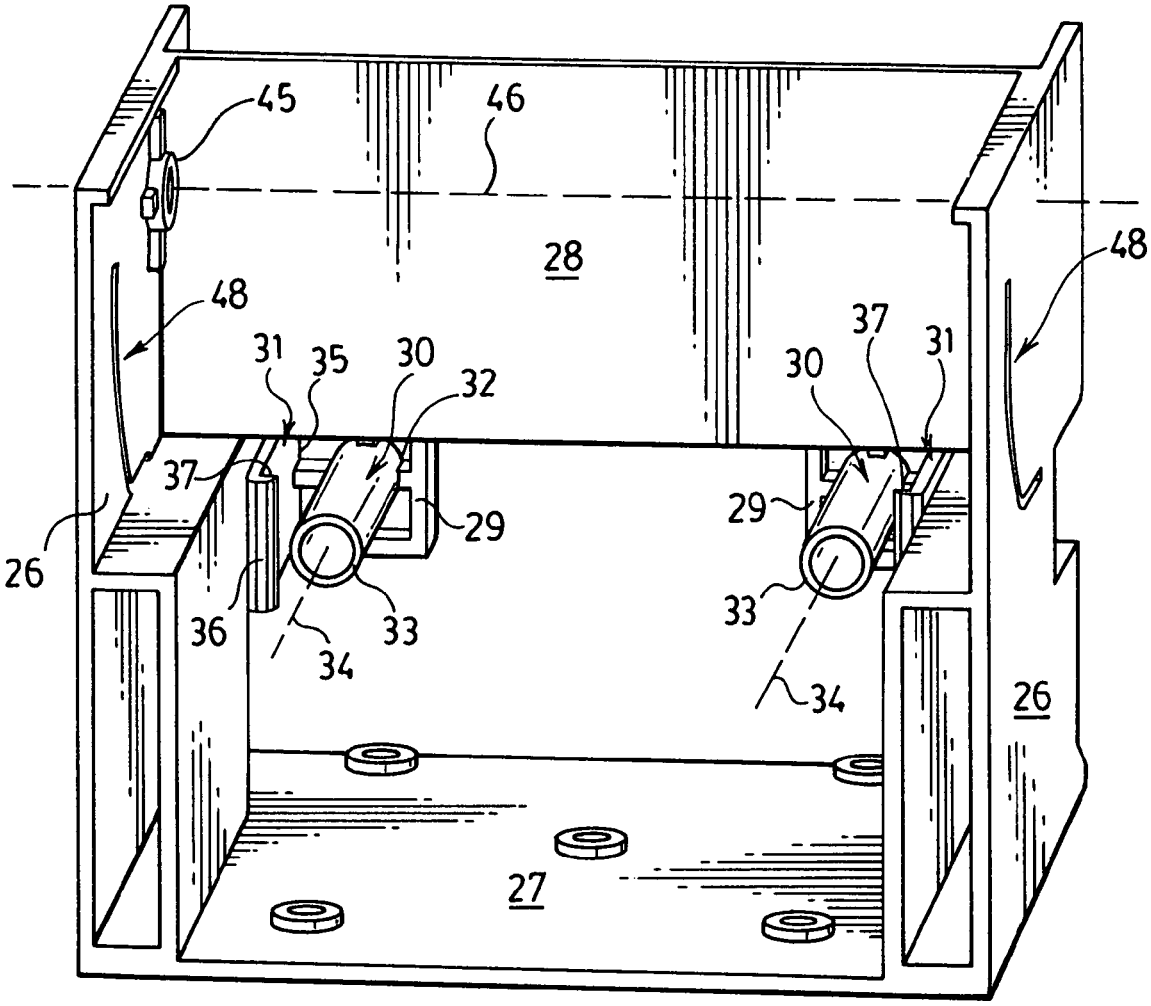
FIG. 3 is a perspective bottom view of the housing shown in FIG. 1.

As best seen in FIG. 3, the housing 11 has a pair of spaced parallel vertical side walls 26 joined at their rear upper edges by a vertical rear wall 27. The side walls 26 are also joined by a horizontal support flange or web 28. Rearward of the web 28, each of the side walls 26 carries a horizontal support plate 29 which has a downwardly directed under surface carrying a cylindrical slide post 30 and a resilient finger-like catch member 31. The slide post 30 has an upper end 32 secured to the under surface of the support plate 29. Each slide post 30 extends downwardly to a distal end 33 about a vertical post axis 34. The catch member 31 extends from an upper end 35 fixed to the under surface of the support plate 29 downwardly to a lower distal end 36. Each catch member 31 is laterally outwardly of its respective slide post 30. Each catch member 31 carries near its lower distal end 36 on a laterally inner side an upwardly directed catch shoulder 37.

Figure 6:
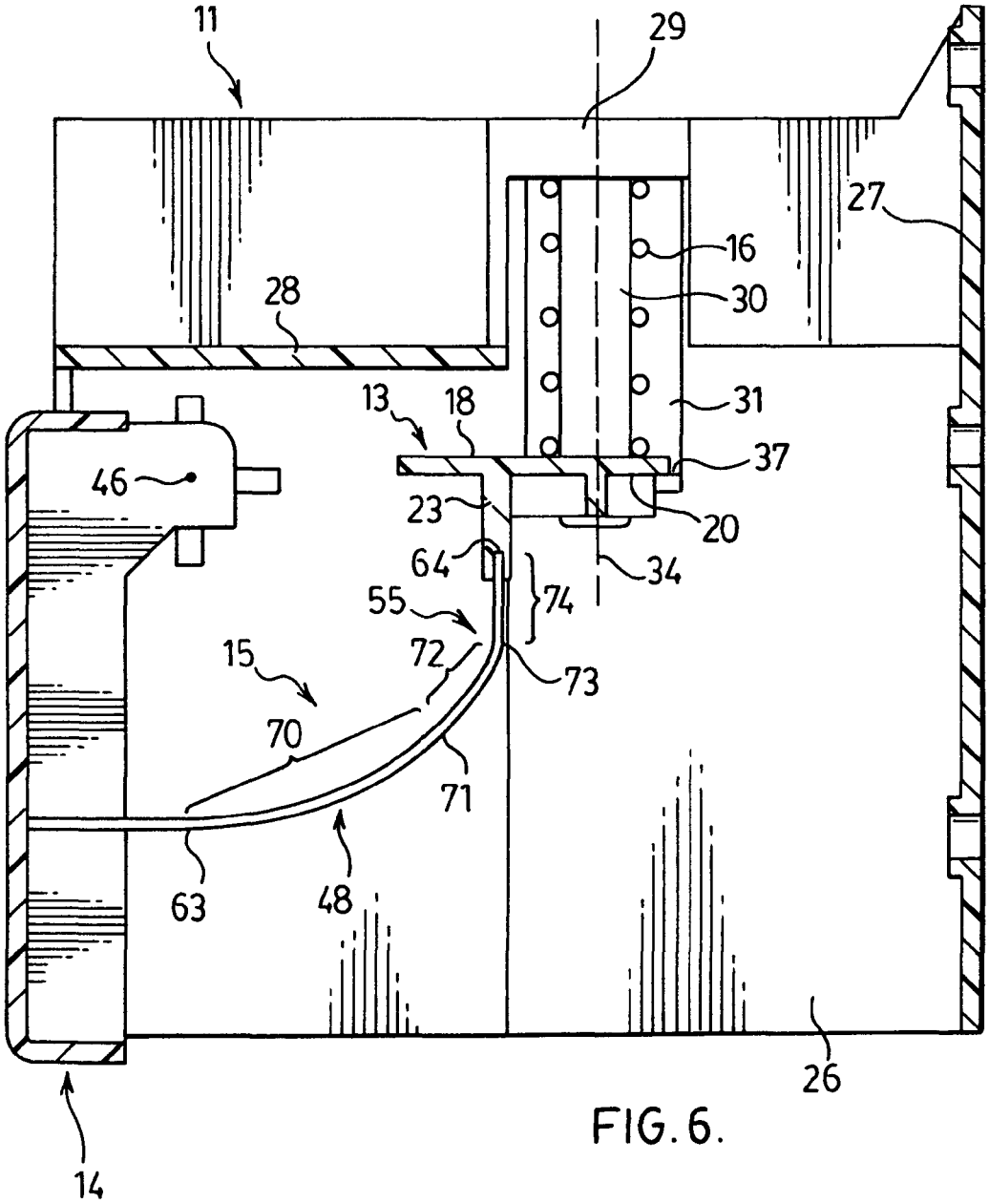
FIG. 6 is a side view the same as in FIG. 5, however, showing the entire motion translation assembly of FIG. 1 in a first extended position.
Figure 7:
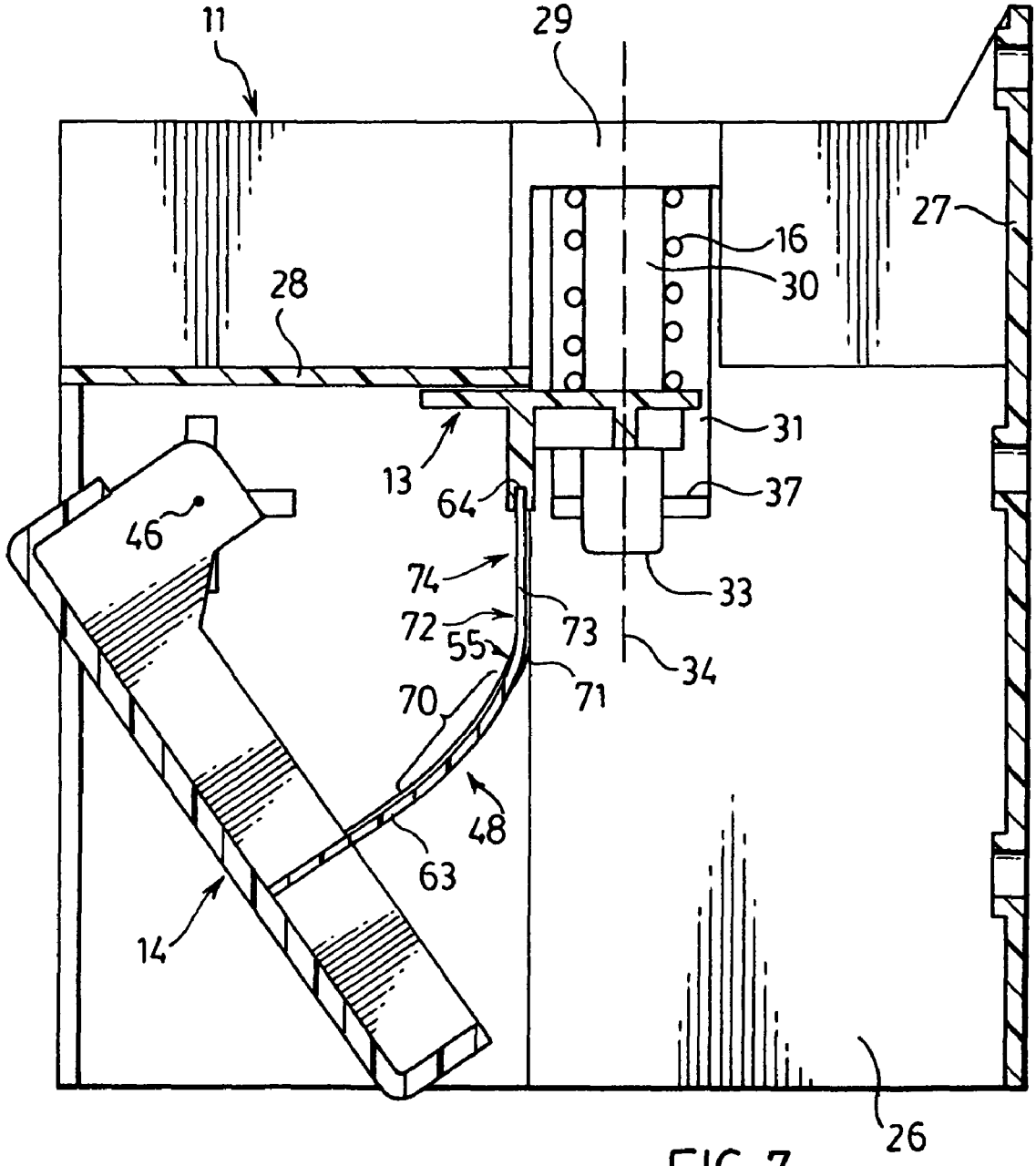
FIG. 7 is a side view the same as shown in FIG. 6, however, with the motion translation assembly in a second retracted position.

As best seen in FIGS. 6 and 7, the slide element 13 is slidably coupled to the housing 11 with the posts 30 closely slidably received within the opening 25 of the slide element 13. For initial assembly, the distal ends 36 of the catch members 31 are displaced laterally outwardly to let the slide element 13 move upwardly therepast on each post 30. Once the slide element 13 is above the catch shoulders 37, the catch shoulders 37, by engaging with the lower surface 20 of the plate 18 adjacent each side end 38 of the slide element 13, prevent moving of the slide element 13 downwardly past an extended position shown in FIG. 6.

The helical coil springs 16 are disposed coaxially about each of the posts 30 with an upper end of each spring 16 engaging the under surface of the support plate 29 and a lower end of each spring 16 engaging the upper surface 19 of the plate 18 biasing the slide element 13 to the extended position shown in FIG. 6 and into engagement with the catch shoulders 37. The slide element 13 is movable in a linear manner relative the housing 11 guided by the posts 30 from the extended position shown in FIG. 6 against the bias of the springs 16 to a retracted position shown in FIG. 7 in which the upper surface 19 of the plate 18 engages a lower surface of the web 28.

The lever 14 has a front presser surface 40, an upper end 41, a lower end 42 and two side ends 43. Each side end 43 carries a stub axle 44 adapted to be journalled in a respective one of two journal bores 45 on the inside of each side wall 26 of the housing 11 such that the lever 14 is mounted to the housing 11 for pivoting about a horizontal pivot axis 46.

Figure 5:
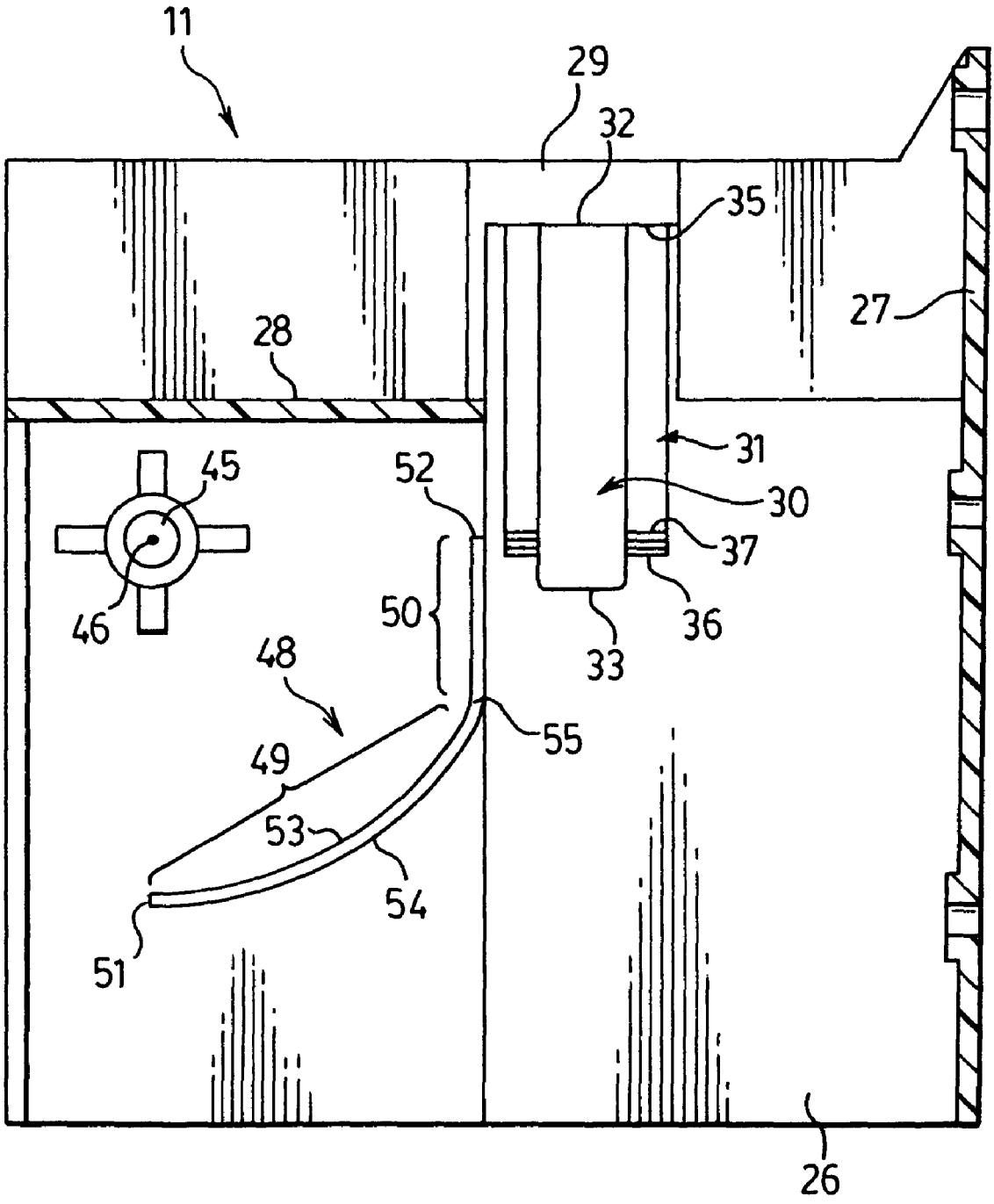
FIG. 5 is a cross-sectional side view of the housing along section line 5-5' in FIG. 2.

The housing side walls 26 each have identical parallel camming slotways 48 extending laterally therethrough. The camming slotways 48, as best seen in FIG. 5, have a lower curved portion 49 with a centerline therethrough lying at a constant radius about the pivot axis 46 through the bore 45. The lower curved portion 49 of each slotway 48 merges tangentially at a point indicated 55 into an upper straight portion 50 which is parallel the post axes 34 of each of the posts 30, that is, vertical as shown in the drawings. The slotway 48 is best seen in side view in FIG. 5 as having a front end 51 and a rear end 52. The slotway 48 has an inner camming surface 53 and an outer camming surface 54, each of which extend from the front end 51 to the rear end 52. Over the curved portion 49, the inner camming surface 53 is disposed at a first constant radius from the pivot axis 46 and the outer camming surface 54 is disposed at a second constant radius from the pivot axis 46 increased over the first constant radius by the thickness of the slotway 48. Over the straight portion 50 of the slotway 48, the inner camming surface 53 and the outer camming surface 54 are straight and parallel to each other and parallel to the post axis 34. Each slotway 48 extends along a longitudinal centerline thereof from its front end 51 to its rear end 52 disposed centrally between the inner and outer camming surfaces 53 and 54. The slotway 48 shown has a constant width between its inner and outer camming surfaces 53 and 54 over the entirety of its longitudinal extent.

Figure 4:
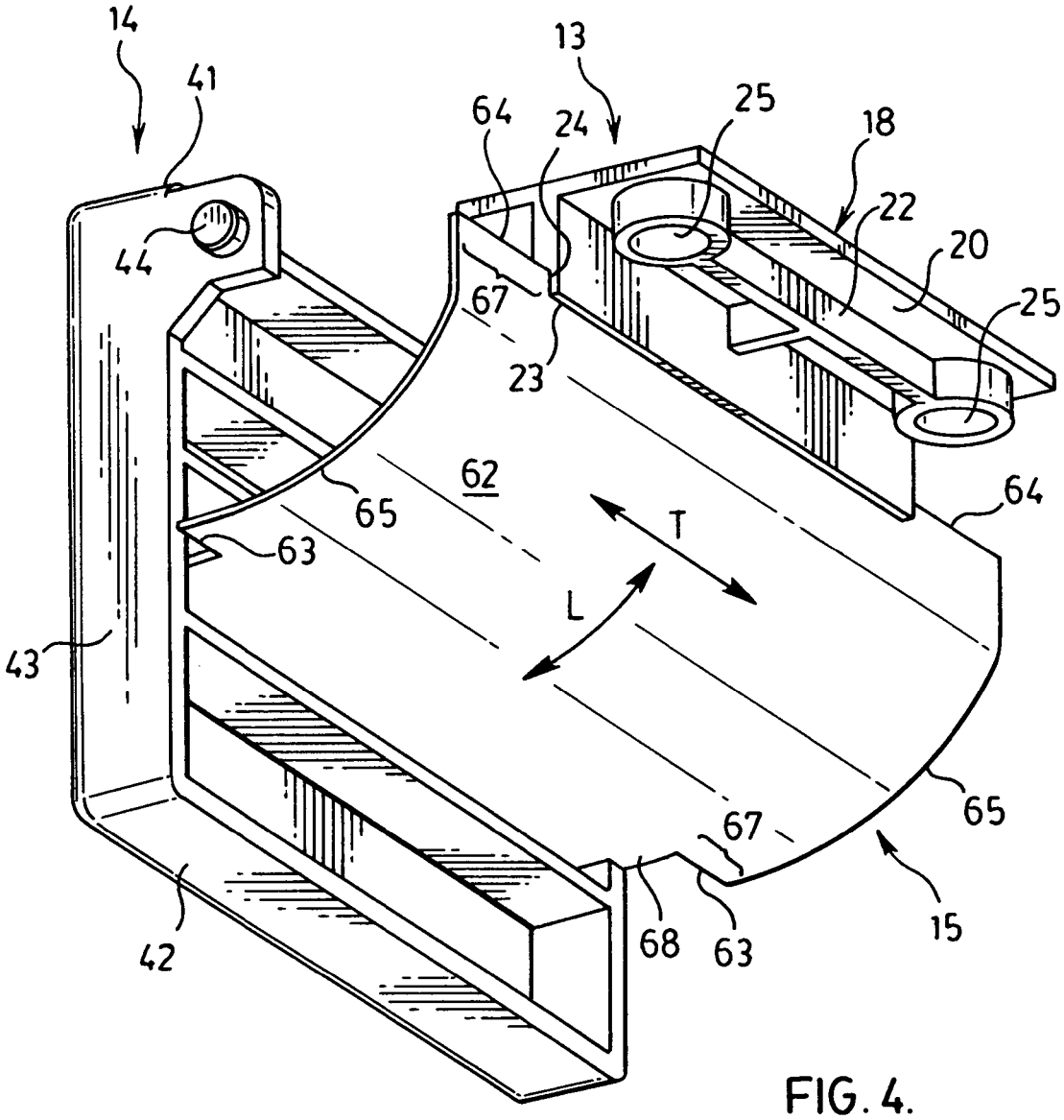
FIG. 4 is a perspective bottom view of the lever, bridge member and slide element shown in FIG. 2.

The bridge member 15 comprises a planar sheet of material having an upper face 60, a lower face 62, a front end 63, a rear end 64 and two side edges 65. The bridge member 15 has its front end 63 secured to the lever 14 by being formed as an integral portion of the lever 14 fixed to a horizontal support arm 68 of the lever 14 and its rear end 64 engaged with the slide element 13 in the channelway 24 of the engagement flange 21 as best seen in FIG. 4.

As seen in FIGS. 1, 6 and 7, the bridge member has proximate each of its left and right side edges 65 side portions 67 which extend laterally through the slotways 48 in each of the side walls 26 of the housing 11 such that each side portion 67 is slidably received in a respective slotway 48. Each side portion 67 of the bridge member 15 bends to assume the configuration of the sections of the slotway 48 in which it is disposed.

The bridge member 15 has its upper face 60 and its lower face 62 parallel and spaced by a distance less than the width of the slotway 48 such that the side portions 67 are slidable longitudinally within the slotways 48. The planar sheet forming the bridge member 15 is, on one hand, sufficiently closely received in the slotways 48 that compressive forces applied to either the front end 63 or the rear end 64 longitudinally of the bridge member 15 results in the bridge member 15 sliding longitudinally in the slotways 48.

The bridge member 15 is sufficiently flexible that with movement to different positions longitudinally in the slotways 48, the bridge member 15 at any longitudinal position in the slotways 48, assumes a shape matching the relative shape of the slotway 48 at that longitudinal position. Referring to FIG. 4, bridge member 15 extends in a longitudinal direction between its front end 63 and its rear end 64 as indicated by the letter L. The bridge member 15 extends in a transverse direction normal its side edges as indicated by the arrow T. In accordance with the preferred embodiment in the assembled motion translation assembly 10, the bridge member 15 and each of its upper surface 60 and lower surface 62 are disposed in a plane which, in the transverse direction T, is parallel to the pivot axis 46 and, in the longitudinal direction, has the shape of the slotways 48.

The upper face 60 of the side portion 67 of the bridge member 15 forms a cammed face 60 for engagement with the inner camming surface 53 of the slotways 48. The lower face 62 of the side portion 67 of the bridge member 15 forms an outer cammed face 62 for engagement with the outer camming surfaces 54 of the slotways 48. Engagement between the inner cammed face 60 and the inner camming surfaces 53 and/or engagement between the outer cammed face 62 and the inner camming surfaces 54 causes the bridge member 15 to be deformed to assume positions as shown in FIGS. 6 and 7 in which the bridge member 15 in side view conforms to the shape of the slotways 48.

FIG. 6 illustrates the actuator assembly 12 in what is referred to as a first position in which the side element 13 is in its extended position and the lever 14 is in a first rotational position about the pivot axis 46. FIG. 7 illustrates the actuator assembly 12 in what is referred to as a second position with the slide element 13 in its retracted position and the lever 14 in a second rotational position relative to the pivot axis 46. The actuator assembly 12 is movable between the positions of FIGS. 6 and 7 as by a user manually applying rearwardly directed forces to the presser surface 40 of the lever 14 pivoting the lever 14 rearwardly about the pivot axis 46. Such pivotal movement of the lever 14 moves the bridge member 15 longitudinally in the slotways 48 rearwardly and upwardly moving the slide member 13 linearly vertically upwardly against the bias of the springs 16 to the second position of FIG. 7. On manual release of the lever 14, the bias of the springs 16 acts on the slide plate 13 which moves the bridge member 15 longitudinally in the slotways 48 downwardly and forwardly pivoting the lever 14 to return to the first position shown in FIG. 6. Thus, the interaction of the housing 11, the bridge member 15, the lever 14 and the slide element 13 results in pivotal movement of the lever 14 being translated into linear movement of the slide element 13 and vice versa.

The side portions 67 of the bridge member engage the slotways 48 at transversely spaced locations on the bridge member 15 as is advantageous to deform the bridge member 15 uniformly longitudinally.

Referring to FIGS. 6 and 7, the bridge portion 15 may be considered to have three sections, namely: a front curved segment 70, a middle flexing segment 72 and rear straight segment 74. The front curved segment 70 of the bridge member 15 is a segment between the front end 63 and point 71 which is always disposed within the curved portion 49 of the slotway 48. Referring to FIG. 7 in the second position, the point 71 is adjacent the transition point 55 of the slotway 48. The rear straight segment 74 of the bridging member is a segment between the rear end 64 and a point 73 which is always disposed within the straight portion 50 of the slotway 48. Referring to FIG. 6 in the first position, the point 73 on the bridge member 15 is adjacent the transition point 55 of the slotway 48. The middle flexing segment 72 of the bridging member 15 is that segment between point 71 and point 73. This middle flexing segment 72 of the bridging member 15 is that segment of the bridging member which must be flexible so as to change its shape as seen in side view in moving between the first position shown in FIG. 6 and the second position shown in FIG. 7. The front segment 70 and the rear segment 74 need not be flexible. Merely the middle flexing section 72 of the bridging member need be provided in the slotways 48 or guided by the slotways 48 so as to conform the bridge member 15 to the desired shape as seen in cross-section of the slotways 48.

Figure 8:
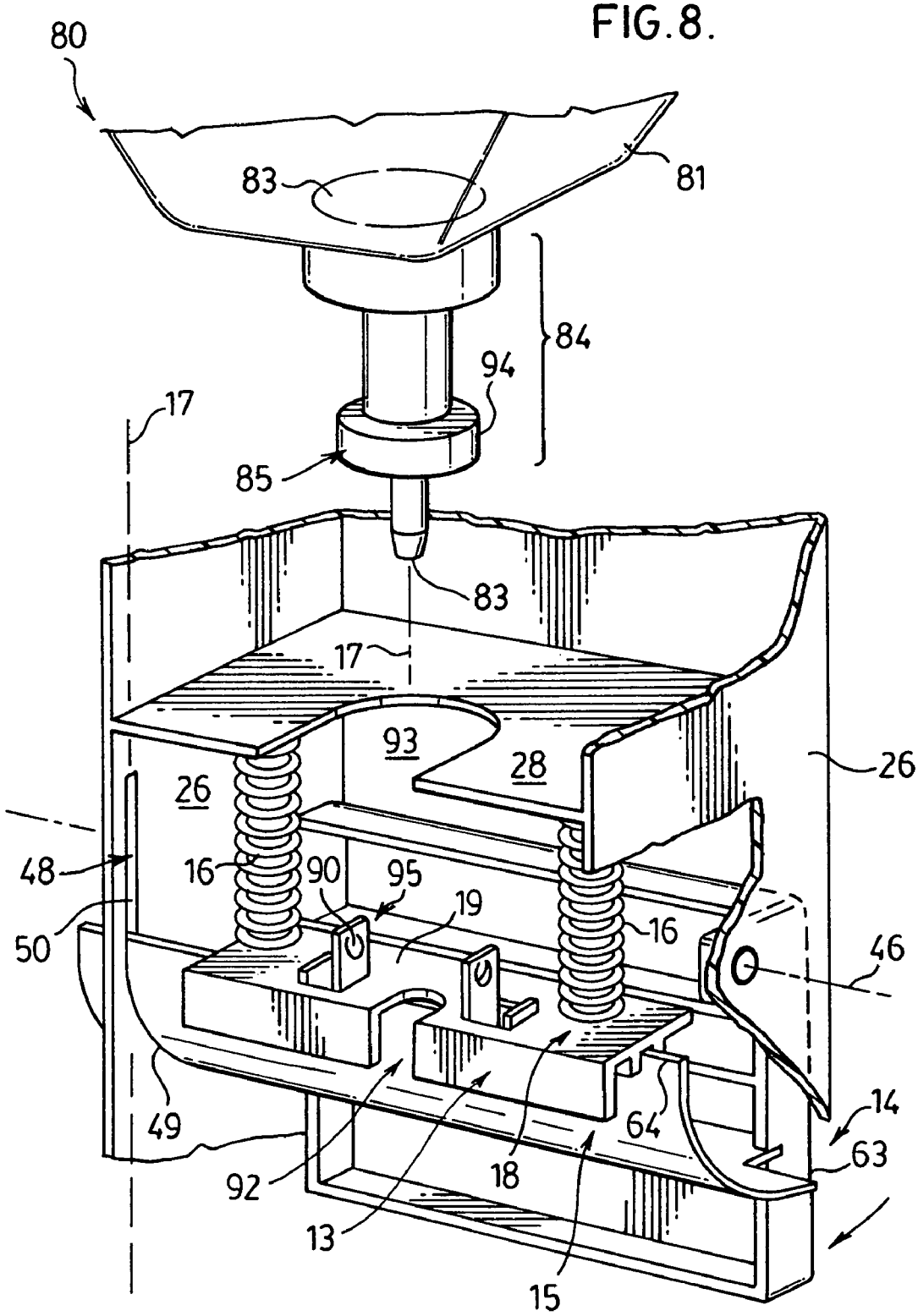
FIG. 8 is an exploded partial perspective view of a second embodiment of a motion translation assembly in accordance with the invention incorporated in a fluid dispenser.
Figure 9:
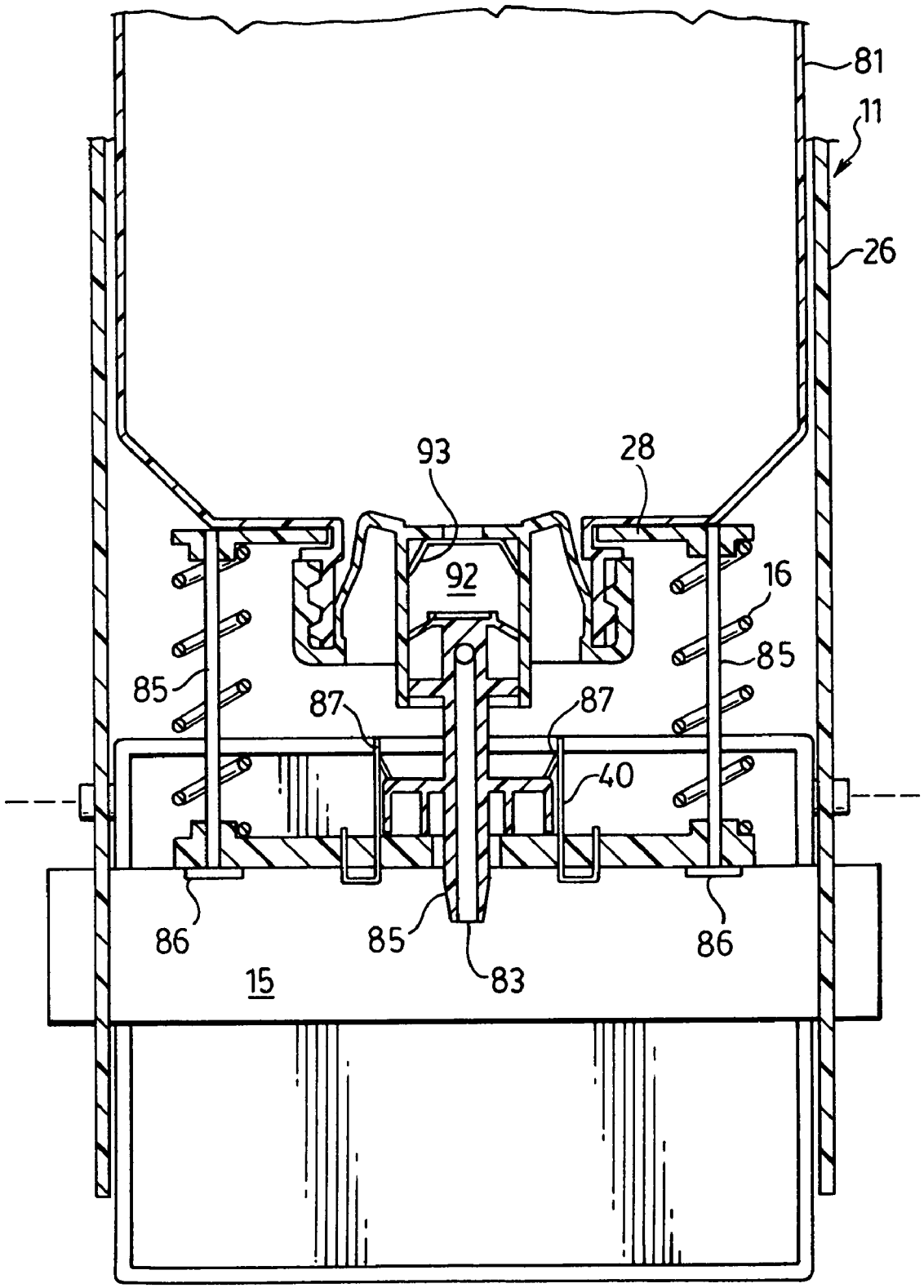
FIG. 9 is a partial cross-sectional view of the dispenser of FIG. 8 in a coupled orientation with the actuator assembly and the reciprocally movable piston element in an extended position.

Reference is made to FIGS. 8 and 9 which show a dispenser 80 in accordance with a second preferred embodiment of the invention. The same reference numerals are used to indicate equivalent elements. The dispenser 80 includes a reservoir 81.

The reservoir 81 forms a chamber for holding fluid as, for example, liquid soap, which is to be dispensed. An opening 83 is provided through a lowermost wall of the reservoir 81, across which a valve assembly 84 is located to regulate the flow of fluid outwardly therethrough. A piston element 85 is linearly coaxially reciprocally slidable along a central longitudinal axis 17 relative the valve assembly 84 between an extended position and a retracted position to dispense fluid from the reservoir 81 out an outlet 83.

FIG. 9 shows the reservoir valve assembly 84 as comprising a dispensing chamber 92 having at an inwardmost end thereof, a one-way valve 93 which permits fluid to flow outwardly only from the reservoir 81 into the dispensing chamber 92. The reciprocally movable piston element 85 is slidably received within the dispensing chamber 92. Reciprocal movement of the piston element 85 along a linear path axially in the dispensing chamber 92 causes fluid to flow from the dispensing chamber 92 outwardly past the one-way valve 93 and out an outermost outlet 83 of the piston element 85 via a passage formed therein. A generally circular radially extending engagement flange 94 carried on the piston element 85 engages with a catch assembly 85 carried on the slide element 13 to couple the piston element 85 to the slide element 13.

The catch assembly 86 for releasably engaging and coupling to the piston element 85 is similar to that disclosed in U.S. Pat. No. 5,431,309 to Ophardt issued Jul. 11, 1995.

As best seen in FIG. 8, the catch assembly 86 includes a pair of substantially parallel spaced metal fingers 87 extended from an upper surface 19 of the plate upwardly with the fingers 87 substantially defining the lateral extent of a cavity or slot therebetween. Each finger 87 comprises a flattened ribbon of metal, formed so that a first endmost portion of each respective finger 87 which is remote from the surface 19 is resiliently deformable from an unbiased position, wherein the fingers 87 assume their substantially parallel configuration, to a biased position, wherein the endmost portions are moved apart.

As shown in FIG. 9, finger endmost portion includes an integrally formed projecting tab 90. The tabs 90 are generally located along each respective finger an equal distance from the surface 19. Each of the tabs 90 projects inwardly and downwardly into the slot 88.

A second endmost portion of each respective finger 87 is secured to the plate 18 as, for example, by snap fitting in complimentary slots formed therethrough. A generally U-shaped passage slot 92 is formed through the plate 18 between the fingers 87.

The radial dimension of the engagement flange 94 is selected to permit its complimentary fitted placement in the slot between the fingers 87. The radial diameter of the flange 98 is preferably selected equal to or marginally smaller than the outermost distance between unbiased fingers 87 and greater than the innermost distance between tabs 90. The radially extending flange 98 preferably has an axial extent marginally smaller than the shortest distance between tabs 90 and the surface 19 so as to permit its fitted placement therebetween. The radially extending flange 98 is sized having a radial dimension larger than the remainder of the piston element 85 so as to engage an endmost surface of the dispensing chamber 82 to limit its inward sliding movement therein.

The web 28 of the housing 11 is provided as generally U-shaped with a rearwardly opening slot 93 formed therein. The U-shaped web 28 is positioned to permit the reservoir 81 to be slid radially inward into the housing 11, in the manner illustrated in FIG. 8. The web 28 is located such that when the reservoir 81 is slid into the housing 11, the web 28 abuts and supports the lowermost wall of the reservoir 81 in the fluid dispensing position. Web 28 also engages part of the valve assembly 84 such that the web 28 is sandwiched between the wall of the reservoir 81 and the valve assembly 84.

FIG. 8 shows a rearview of the housing 11 ready for insertion of the reservoir 81. With the reservoir 81 inserted in the housing, the reservoir 81 is in a dispensing position as seen in FIG. 9 wherein the fluid may be dispensed outwardly via the valve assembly 84. An actuator assembly 12 is provided in the housing 11, movable relative to the housing 11 to activate the movable piston element 85 of the valve assembly 84, and dispense fluid.

The actuator assembly 12 includes an actuator slide element 13, a lever 14, and a flexible bridge member 15 connecting the slide element 13 to the lever 14. The lever 14 is pivotally connected to the housing 11 for pivoting about a pivot axis 46.

The slide element 13 is coupled to the housing 11 for linear movement about the straight longitudinal axis 17 relative the housing, shown to be vertical in FIG. 8 and parallel with the axis coaxially through the piston element 85 when the piston element 85 is coupled to the slide element 13.

The slide element 13 is slidably mounted on two parallel spaced locating rods 85 secured at a first end to a support flange or web 28 of the housing 11. At a second end, each locating rod 85 extends through respective openings formed through the plate 18 of the slide element 13. A retaining ferrule 86 secured about the second end of each rod 85 prevents the complete withdrawal of each locating rod 85 from the plate 18. In this manner, the slide element 13 is guided in sliding movement linearly along the rods 85, between the extended position shown in FIG. 8, wherein the plate 18 abuts against ferrules 86, and a retracted position wherein the plate 18 is moved along rods 85 a distance towards the web 28.

Springs 16 are provided about each of the locating rods 85 respectively. The springs 16 are sized to engage both the web 28 and the plate 18, to resiliently bias the slide element 13 to the extended position.

The housing side walls 26 each have identical parallel camming slotways 48 extending therethrough. The camming slotways 48 have a curved lower portion 49 lying at a constant radius about the pivot axis 46. The curved lower portion 49 merges tangentially into a straight portion 50 which is parallel the longitudinal axis 17, that is, vertically as shown.

The flexible bridge member 15 comprises a planar sheet of flexible plastic material. The bridge member 15 has its front end 63 engaged with the lever 14 and its rear end 64 engaged with the plate 18. Side portions of the bridge member 15 proximate each of its right and left side edges are slidably received in a respective right and left of the camming slotways 48 with each side portion of the bridge member 15 bending to assume the configuration of the portions of the slotways 48 in which it is disposed.

The reservoir 81 is slid into the housing 11 such that the lower wall is positioned abutting the U-shaped web 28, with the web 28 sandwiched between part of the lower wall 94 and a threaded rim of the valve assembly 84. As the reservoir 81 is inserted, the engagement extending flange 94 slides radially into position intermediate the fingers 87 and the outlet 83 of the piston element 85 moves into the U-shaped passage slot 92.

When the reservoir inserted in the housing 11 in a position for dispensing, the slide element 13 and the piston element 84 are coupled to each other with the engagement flange 94 between the trailing edges of each respective tab 90 and at a lower extent by the surface 19.

Manual pivotal movement of the lever 32 as by a user in the direction of the arrow shown in FIG. 8 moves the front end 64 of the bridge member 15 in the curved lower portion 49 which displaces the bridge member 15 longitudinally relative the slotways 48 and moves the rear end 64 of the bridge member 15 in the straight upper portion 50 linearly upward which displaces the slide element 13 linearly upward to overcome the force of the springs 16, moving the slide element 13 and the piston element 85 as a unit upwardly from the extended position to a retracted position to dispense a quantity of fluid. On release of the lever 14, the force of the springs 16 returns the slide element 13, the piston element 85, bridge member 15 and lever 14 to the extended position.

Figure 10:
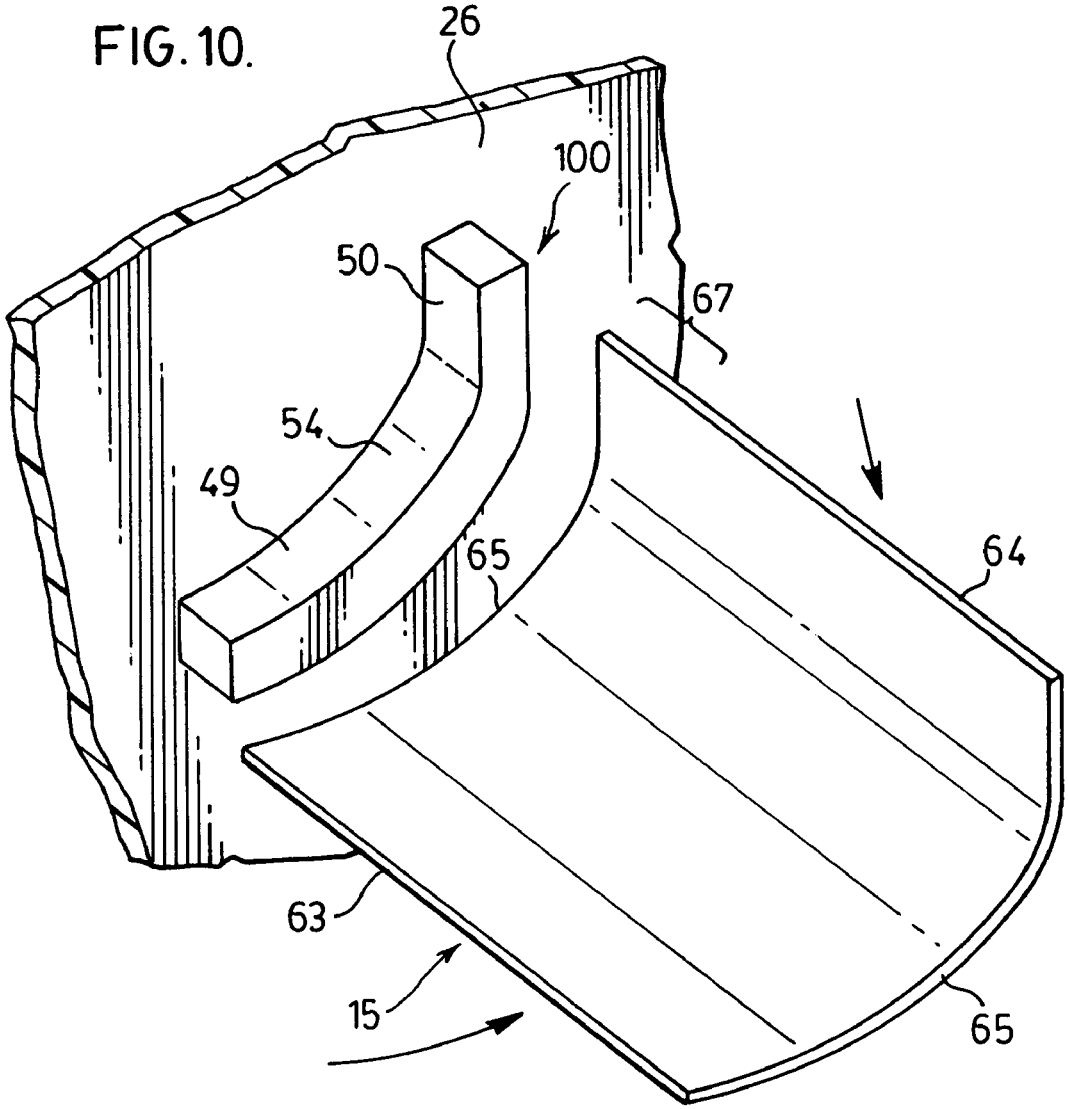
FIG. 10 is a schematic perspective view showing an alternative embodiment of a camming surface and a complementary bridge member.

Reference is made to FIG. 10 which schematically illustrates a modification of the embodiment shown in FIGS. 1 to 7 and shows, as a substitution for the slotway 48, the inside surface of one side wall 26 of the housing 11 as carrying a laterally inwardly extending camming boss 100 carrying the outer camming surface 54 directed forwardly and upwardly and having the curved portion 49 and the linear portion 50. With merely an outer camming surface 54 provided on each side wall, the side portions 67 of the bridge member 15 is to have its outer cammed face 62 urged into engagement with the outer camming surface 54 as by compressive forces indicated by the arrows being applied to each of the front end 63 and rear end 64 of the bridging member 15 longitudinally thereof.

Figure 11:
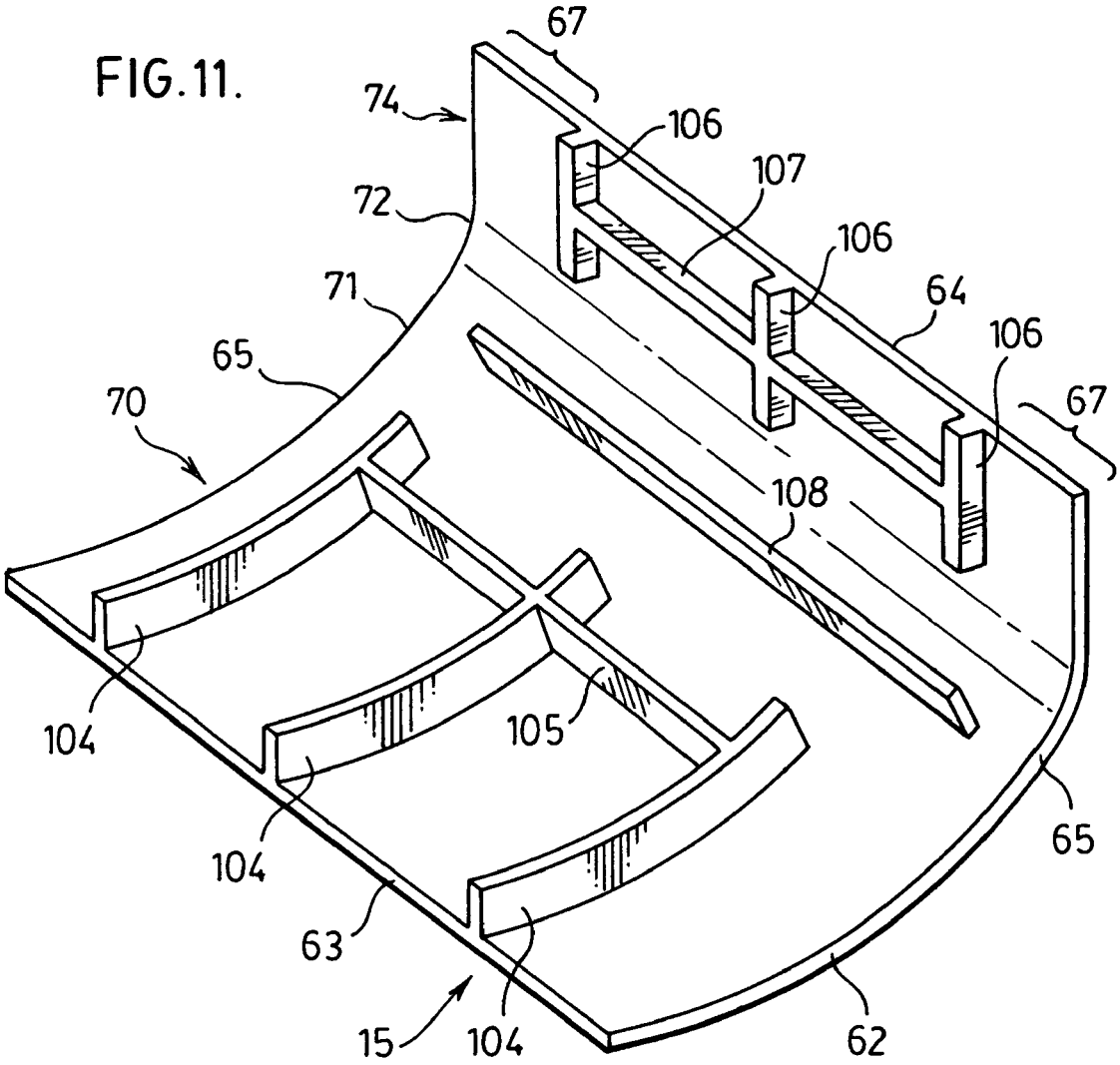
FIG. 11 is a pictorial view of an alternative reinforced embodiment of the bridge member.

Reference is made to FIG. 11 which schematically illustrates a modification of the bridging member of FIGS. 1 to 7 to include reinforcing stiffening ribs. On the curved segment 70 of the bridging member 15, three longitudinally extending ribs 104 are provided to provide rigidity in the longitudinal direction and maintain the cammed faces over the curved segment 70 at a constant radius from the pivot access 46. As well, on the curved segment 70, a transversely extending rib 105 is provided to provide rigidity and maintain a transverse section of the curved segment 70 parallel to the pivot axis 46. On the linear segment 74 of the bridging member 15, three longitudinally extending ribs 106 are provided to maintain the cammed faces linear over the linear segment 74. Similarly, on the linear segment 74, a transversely extending rib 107 is provided. On the middle flexing segment 72 of the bridging member 15, a thin transversely extending rib 108 is provided to assist in maintaining a transverse section of the flexing segment 72 parallel the pivot axis 46 without impeding its ability to flex longitudinally.

The preferred embodiment of FIGS. 1 to 7 illustrates the bridging member 15 as being formed as an integral part with the lever 14. Manufacturing the bridging member as an integral plastic element with at least one of the lever member 14 or the slide member 13 has the advantage of reducing cost in having less parts required for assembly. This is not necessary and the bridge member 15 may be a separate element as shown in FIGS. 10 and 11. It is appreciated that the bridging member at least over its flexing portion 72 is desired to have flexible characteristics such as that seen in side view, it will assume different shapes conforming to the camming surfaces. It may be desired, therefore, to provide the bridging member to be of a different material than the lever 14 or slide member 13 such as of a more flexible plastic than plastic out of which the other components such as the lever or the slide element 13 may be formed. In a similar manner to which the bridging member 15 is removably engaged with the slide element 13, the forward end 63 of the bridging element could also be removably engaged with the lever 14. The bridging element 15 may be formed from flexible material including suitable plastics and a sheet of thin metal.

In the first preferred embodiment of FIGS. 1 to 7, the bridging member 15 is illustrated as having a curved segment, a middle flexing segment 72 and a linear segment 74. The bridging member 15 need have only middle flexing segment 72. The flexing segment 72 could be a separate element and the curved portion 70 of the bridging member 15 may be eliminated or, alternately, provided as an integral portion of the lever 14. Similarly, the linear segment 72 of the bridging member 15 illustrated in the preferred embodiment is not necessary or may be provided as an integral portion of the slide element 13.

In accordance with the preferred embodiment, the bridging member is illustrated as a planar member with rigidity to forces applied parallel to its longitudinal, however, which may be bent out of the plane of the planar member. In the preferred embodiment of FIGS. 1 to 7, the bridge member is deformed between the pair of spaced slotways 48 so as to assume a configuration in which the bridge member 15 is located such that it extends transversely normal to its side edges 65 parallel to the pivot axis 46. Having the bridging member 15 bent to assume a curved shape along its longitudinal resists curving transversely and thus assists in maintaining a bridging member along any transverse section normal to its side edges 65 to be parallel the pivot axis.

As illustrated in FIG. 11, various reinforcing mechanisms may be provided such as the longitudinally extending ribs over the curved and linear segments 70 and 74 of the bridging member or the transversely extending ribs over each of the curved, flexing or linear segments 70, 72 and 74 of the bridging member 15 to assist in permitting and providing desired flex characteristics to the bridging member 15.

The bridging member 15 may comprise a member, preferably which is flat and planar, which has an inherent tendency to assume a flat planar configuration and which needs to be flexed against its bias to assume a curved configuration. The bridging member may have an inherent tendency to assume a curved configuration of a constant radius and which needs to be flexed against its bias to assume a linear configuration. The inherent curved configuration could have a constant radius which is of a radius greater than a radius of the outer camming surface about the pivoting axis such that the application of compressive forces to each end of the bridging member will tend to bias the bridging member to maintain it in engagement with the outer camming surface.

The camming slotways 48 are shown with inner camming surface 53 and outer camming surface 54 over the entirety of the slotway 48 being able to engage with, respectively, either the outer cammed face 60 or the inner cammed face 62 of the bridging member. This is not necessary and only one of inner camming surface 53 or the outer camming surface 54 need be provided when the bridging member 15 is suitably urged into the inner or outer camming surfaces as are provided.

Figure 12:
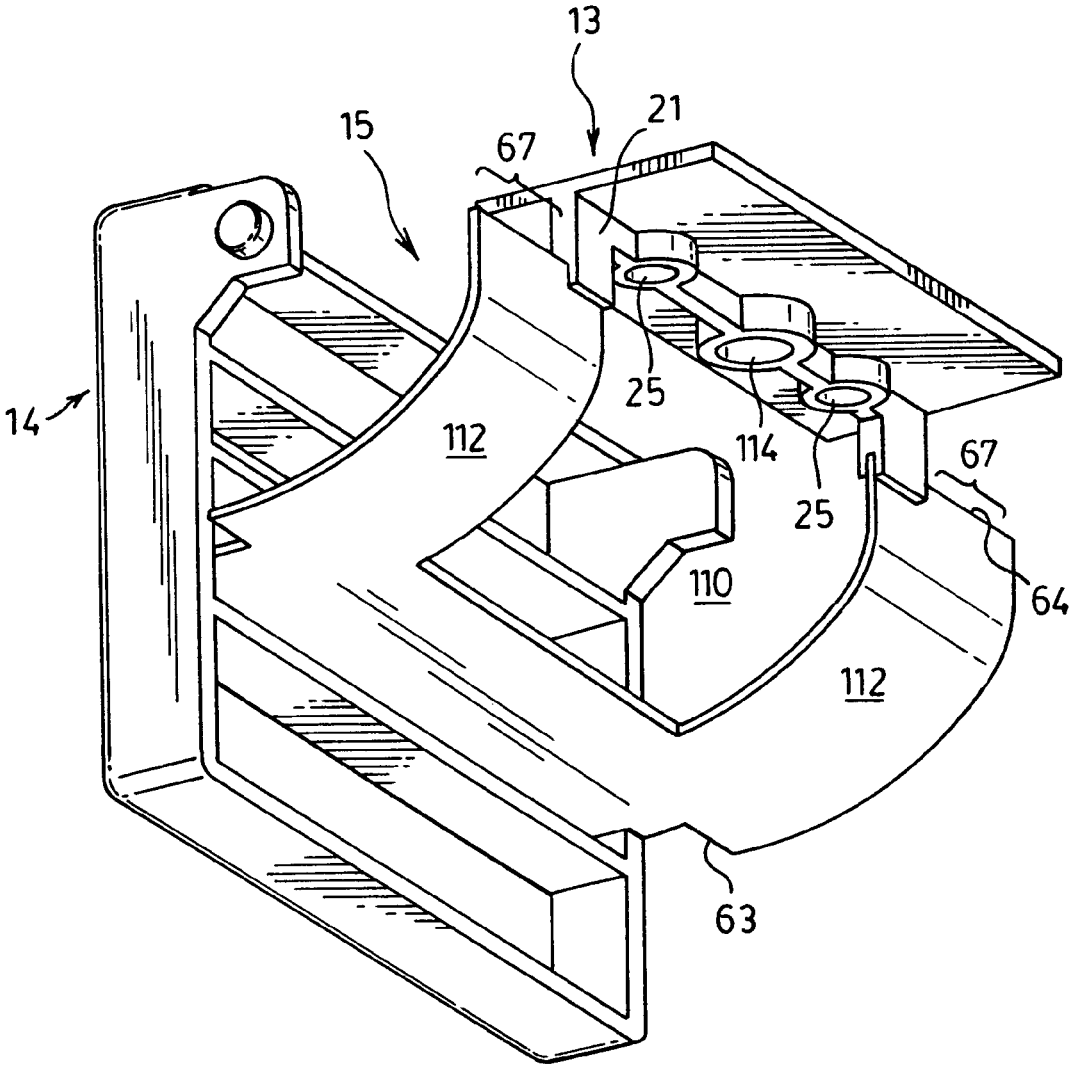
FIG. 12 is a perspective bottom view similar to FIG. 4 but of an alternative embodiment of the bridge member and slide element.

Reference is made to FIG. 12 which schematically illustrates a modification of the actuator assembly 12 in which the bridging member 15 is bifulcated at its inner end 64 so as to have a U-shaped configuration with a central bight 110 between a pair of side arms 112 with each side arm carrying a side portion 67. The openings 25 through the slide plate 13 for the posts 30 have been moved inwardly and centered on the engagement flange 21. Between the openings 25, a central opening 114 is provided as for passage of an outlet nozzle (not shown) of a piston element of the type shown in FIG. 8. The arrangement of FIG. 12 provides for the linear forces applied to the slide member 13 to be centered in a vertical plane including the post axes centrally through each opening 25 and an axis centrally through the central opening 114.

The bridge member 15 is show as longitudinally slidable relative to the camming surfaces 53 and 54. Preferably, each of the sliding surfaces, including the camming surfaces 53 and 54 and the cammed faces 60 and 62, will have low coefficients of friction as well as being smooth. While the cammed faces 60 and 62 are shown as continuous surfaces, a series of low friction stub axles could be provided in substitution along each side of the bridge member 15.

The bridge member 15 may be selected to have an inherent tendency to assume a shape and must be forced against its bias as, for example, to move from the extended position to the retracted position. This can have the positive result that the bridge member 15 may itself serve the function of the springs 16 with the springs 16 being eliminated or reduced in their strength.

The bridge member 15 may be selected to be a member which transfers forces applied longitudinally to its front and rear ends but readily assumes different curved shapes longitudinally so as to reduce friction between the cammed faces and camming surfaces and thereby reduce the manual force required to move the lever 14 to the retracted position and the force of the springs 16 to return the lever 14 to the extended position.

Figure 13:
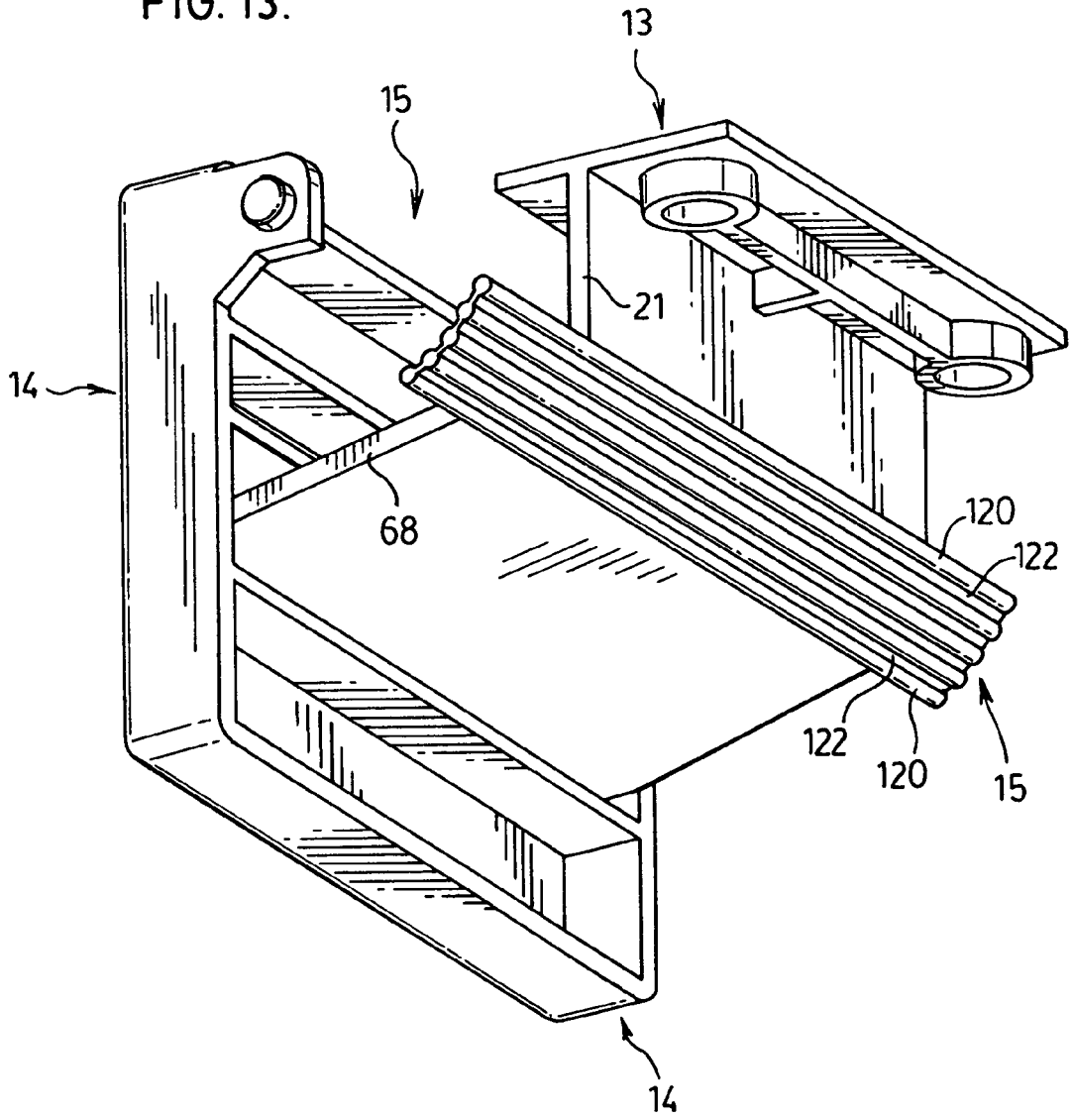
FIG. 13 is a perspective bottom view similar to FIG. 4 but of another alternative embodiment of the lever, bridge member and slide element.

In this regard, reference is made to FIG. 13 schematically illustrating another modification of the actuator assembly 12 in which the bridge member 15 is formed from plastic as a series of elongate cylindrical rods 120 interconnected by short webs 122. The ends of each rod 120 is to be received within the slotways 48. The bridge member 15 is limited to merely providing the flexing segment 72 with the engagement flange 21 on the slide element 13 being extended over that in FIGS. 1 to 7 and, similarly, the support arm 68 of the lever 14 being extended. While each of the slide element 13, lever 14 and bridge member 15 could be made as separate elements, the bridge member 15 of FIG. 13 is made with the lever 14 and the slide element 13 as one unitary element from plastic by injection moulding.

Figure 14:
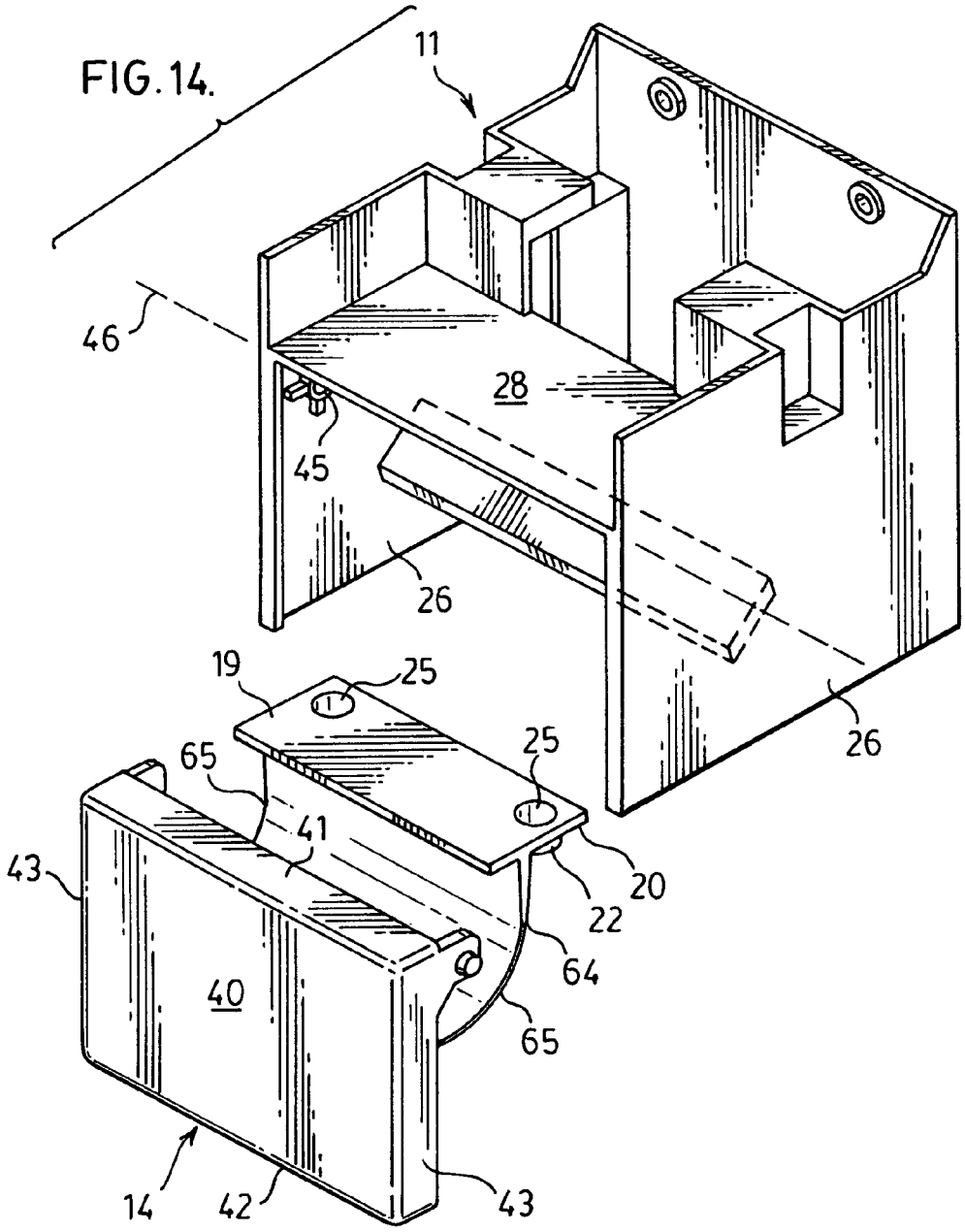
FIG. 14 is an exploded perspective view similar to that of FIG. 2, however, showing another alternative embodiment of a motion translation assembly in accordance with a third embodiment of this invention.
Figure 15:
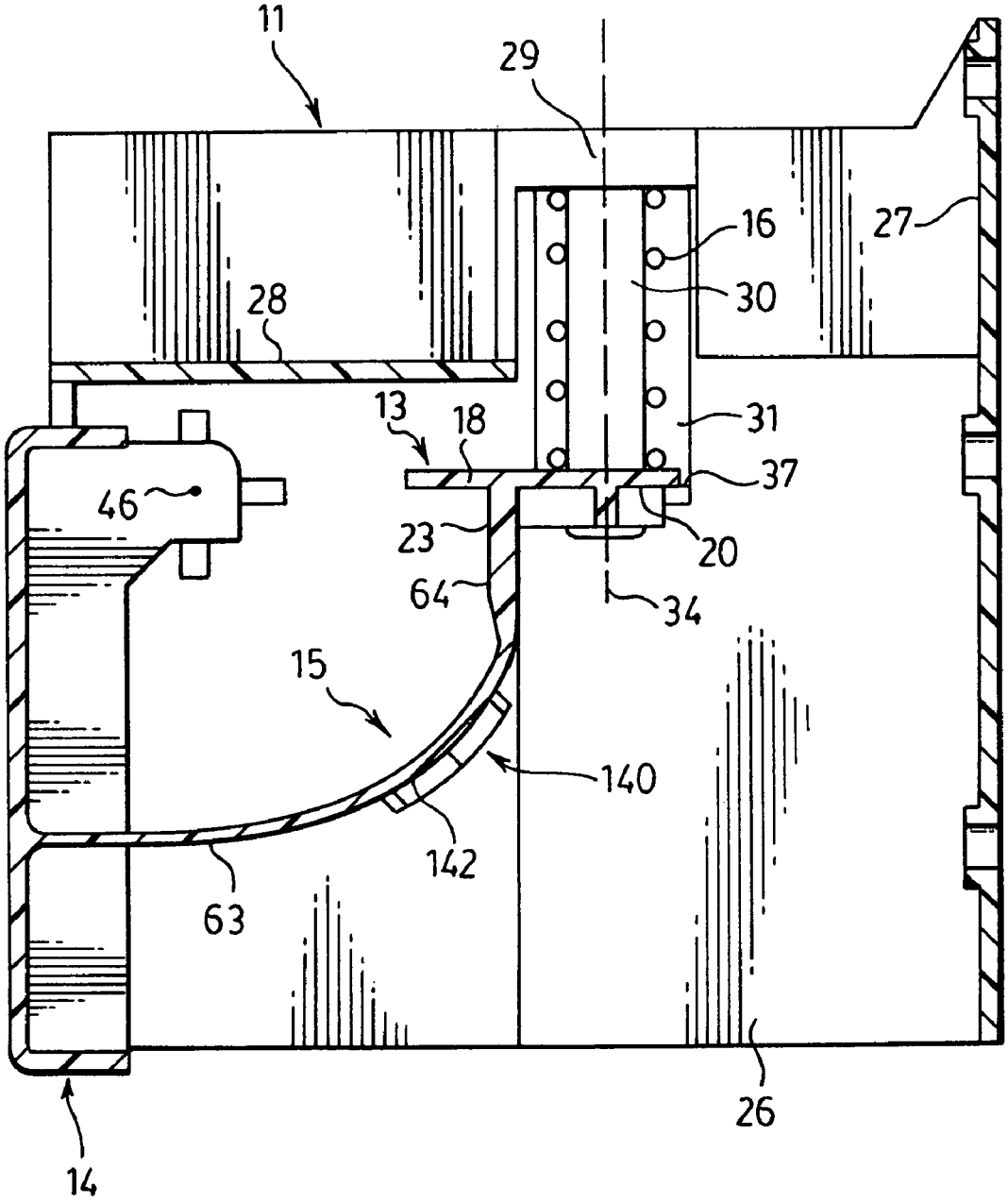
FIG. 15 is a cross-sectional side view similar to that in FIG. 6 but through the assembly of FIG. 14.

Reference is made to FIGS. 14 and 15 which show a third embodiment of a motion translation assembly 10 in accordance with the present invention. The motion translation assembly 10 of FIGS. 14 and 15 is identical to that shown in FIGS. 1 to 7, however: without the springs being shown; with the lever 14, bridge 15 and slide element 13 comprising an integral element as formed together by injection moulding; with the camming slots 48 of the first embodiment being replaced by a camming plate 140 which forms an integral part of the housing 11 and extends as a rigid member between the side walls 26; and with the bridge member 15 being reduced in transverse dimension in FIG. 14 compared to that shown in FIG. 1. The camming plate 140 has an outer surface 142 directed towards the pivot axis 46 and which preferably, as shown, is disposed at a constant radius from the pivot axis 46. The camming plate 140 forms its camming surface 142 to be comparable to a portion of the camming surface as shown in FIG. 5 forwardly from the transition point 55 towards the first end 51 of the slot in FIG. 5, however, with the camming surface 142 being of a lesser longitudinal extent measured, for example, arcuately about the pivot axis 46 than as illustrated in FIG. 5. The slide plate 13 is guided for linear motion vertically as by engagement with the pins 36 and the lever 14 is guided for pivotal movement as about the pivot axis 46. The camming plate 140 serves merely to provide a central portion between the notional ends 163 and 164 of the bridging member 15 so as to deflect a center portion of the bridging member 15 to move from a generally vertical orientation into a general horizontal orientation. The particular curve of the camming surface 142 need not, therefore, be a radially about the pivot axis 46 nor need the camming surface 142 have an upper portion which is disposed to be linear and vertical parallel to the post axis 34.

Figure 16:
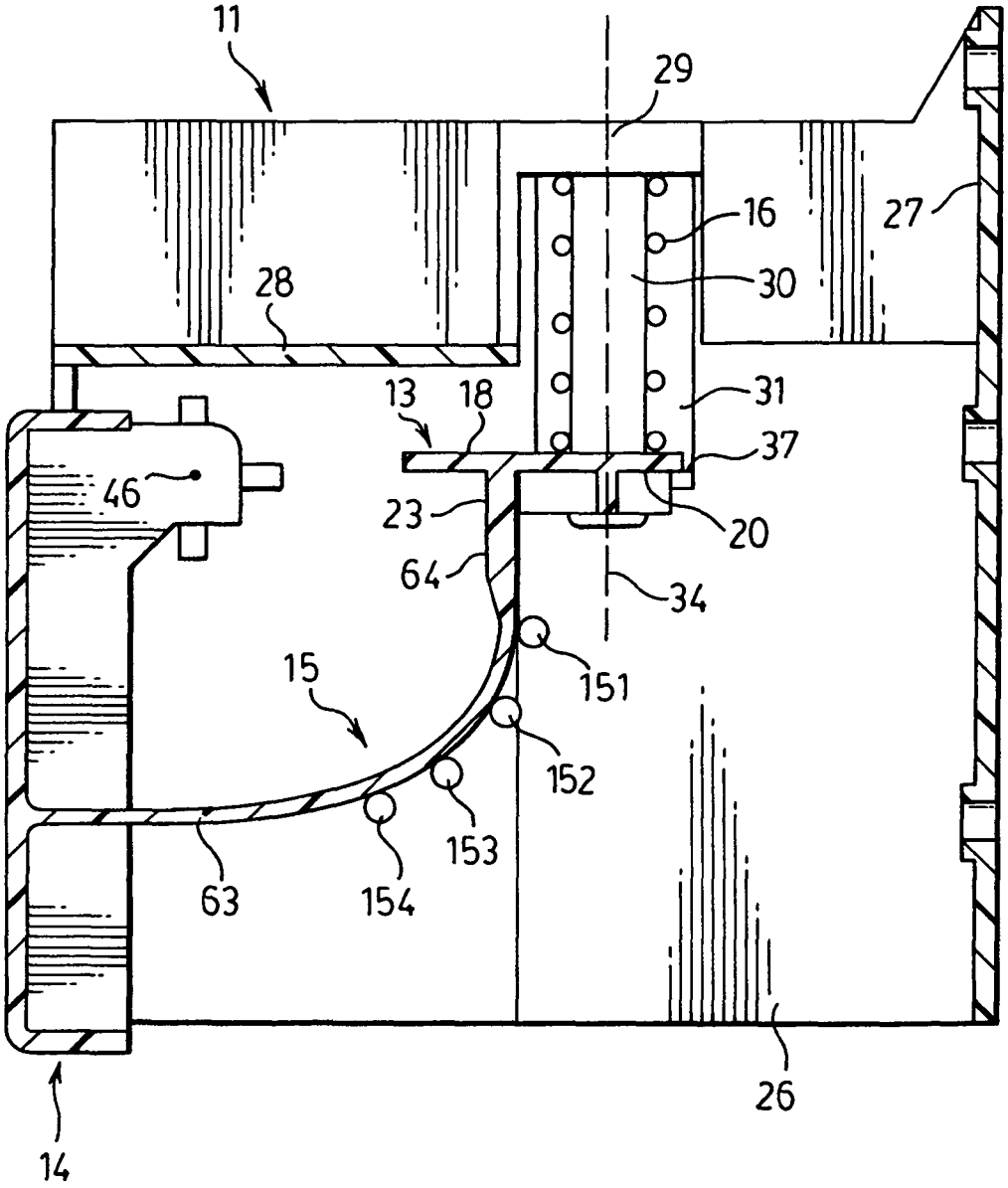
FIG. 16 is a cross-sectional side view similar to that shown in FIG. 15 but with an alternate embodiment of the camming elements.

Reference is made to FIG. 16 which illustrates a side view of an embodiment identical to that in FIG. 15, however, with the exception that the camming plate 140 is replaced by a plurality of transversely extending cylindrical camming rods 151, 152, 153 and 154 which extend parallel to each other transversely between the walls 26. It is to be appreciated that only one such rods may be necessary although generally at least two of such rods would be preferred. The device could be operative with merely one such rod or any two of the rods 151, 152, 153 and 154 depending, amongst other things, upon the resistance of the bridge member 15 to bending out of its plane. The rods, whether one or two or more need not be dispersed to lie with their surfaces in the curved portion 49 of the camming slotways in FIGS. 1 to 7 nor in the linear portion 50 of the camming slotways 50 in FIGS. 1 to 7, although his may be preferred.

Figure 17:
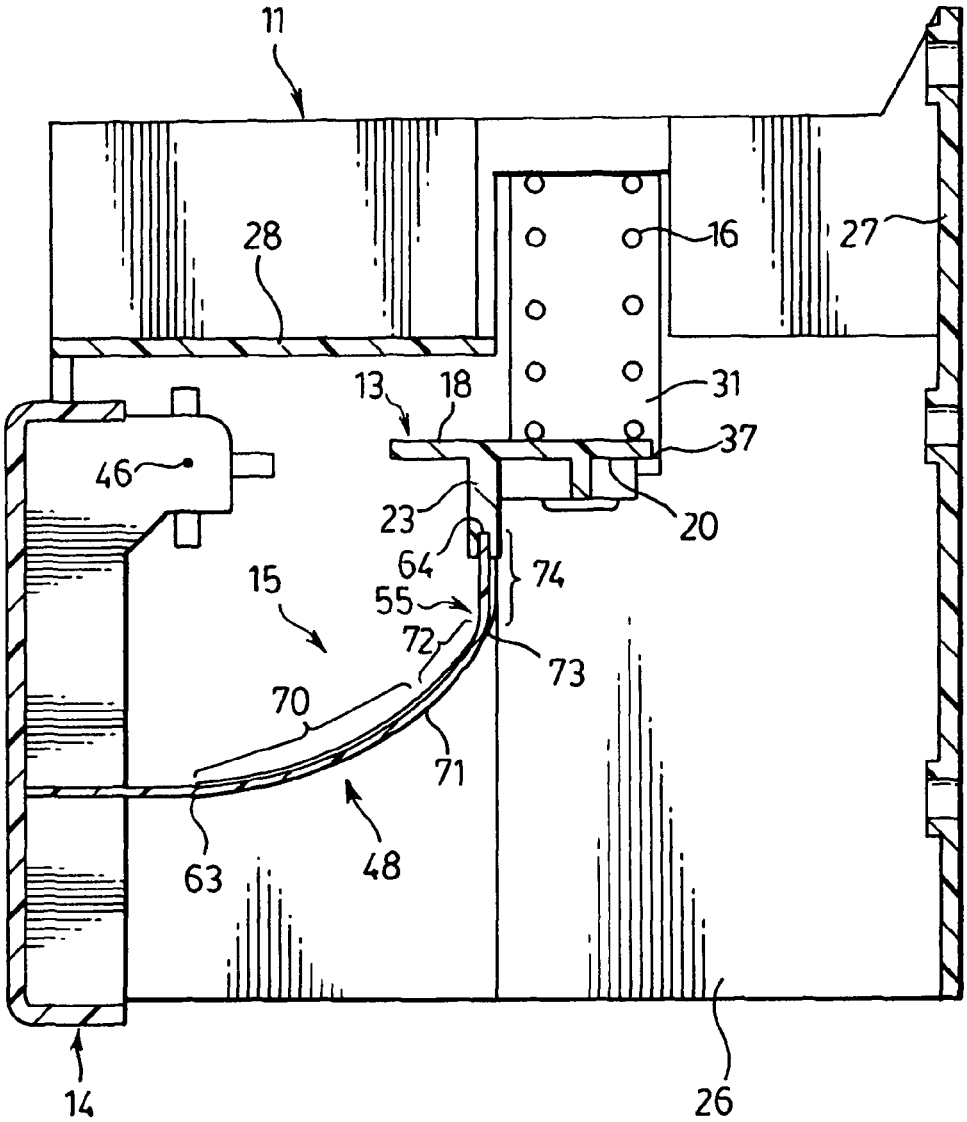
FIG. 17 is a cross-sectional side view similar to that shown in FIG. 6 modified to eliminate the guide posts.

Referring again to the embodiment illustrated in FIGS. 1 to 7, the preferred embodiment incorporates both linear portions of the slot 48 to assist in guiding in linear movement and, as well, the posts 30 which engage the slide member 13 to guide the slide member in sliding vertically. Reference is made to FIG. 17 which illustrates a modification of the embodiment shown in FIG. 6 in which the post member 30 has been eliminated and the slide element 13 is guided for linear sliding by reason of the engagement of the bridge member 15 in the linear portions of the camming slots 48 and the connection between the rear end 64 of bridge member 15 and the slide element 13 resisting relative pivoting.

The preferred embodiments show translation of arcuate motion into linear motion, however, the invention is not so limited. For example, horizontal linear movement as by a push button at the front end of the bridge member could be translated into vertical linear movement at the rear end of the bridge member. The shape of the slotways or the relative guiding of the members connected at each of the front and rear ends of the bridge member establishes the movement at one end relative the housing and can be selected to be movements other than linear or radial.

While the invention has been described with reference to preferred embodiments, it is not so limited. Many variations and modifications will now occur to persons skilled in the art. For a definition of the invention, reference may be made to the appended claims.

I claim:

1. A dispenser comprising:

a housing, a dispensing mechanism including a slide element mounted to the housing for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having a camming surface disposed at a constant radius from the pivot axis, a flexible bridge member having a first end, a second end, a first side edge, a second side edge, and a cammed face, the bridge member coupled to the housing between the slide element and the lever with the first end of the bridge member engaging the lever, the second end of the bridge member engaging the element, and the cammed face of the bridge member urged into sliding engagement with the camming surface of the housing such that the bridge member between its first end and second end is deformed to assume the shape of the camming surface of the housing where the cammed face of the bridge member engages the camming surface of the housing, the bridge member slidable with the cammed face of the bridge member in engagement with the camming surface of the housing between: (a) a first position in which the slide element is in the extended position and the lever is in a first rotational position relative the pivot axis and, (b) a second position in which the slide element is in the retracted position and the lever is in a second rotational position rotated from the first rotational position about the pivot axis.

2. A dispenser as claimed in claim 1 wherein the camming surface extending from a first end to a second end, the camming surface having an arcuate portion and a linear portion, the arcuate portion extending from the first end to where it merges into the linear portion, the linear portion extending from the arcuate portion to the second end, over the arcuate portion the camming surface disposed at a constant radius from the pivot axis, over the linear portion the camming surface being parallel to the longitudinal axis and directed to intersect with the slide element, the camming surface over the linear portion comprising a tangential extension of the camming surface where the arcuate portion merges with the linear portion.

3. A dispenser as claimed in claim 2 wherein in the first position in which the slide element is in the extended position, the cammed face is entirely engaged with the linear portion of the camming surface and, in the second position in which the slide element is in the retracted position, the cammed face is entirely engaged with the arcuate portion of the camming surface.

4. A dispenser as claimed in claim 3 wherein in moving between the first position and the second position, the cammed face of the bridge member sliding relative the camming surface from being either fully engaged with the arcuate portion or the linear portion, respectively, to intermediate positions in which the cammed face is partially engaged with the arcuate portion and partially engaged with the linear portion.

5. A dispenser as claimed in claim 4 wherein the cammed face having a first end and a second end, in the first position, the first end of the cammed face is engaged with the arcuate portion of the camming surface proximate the first end of the camming surface and the second end of the cammed face is engaged with the linear portion of the camming surface spaced from the second end of the camming surface and, in the second position, the first end of the cammed face is engaged with the arcuate portion of the camming surface spaced farther from the first end of the camming surface than in the first position and the second end of the cammed face is engaged with the linear portion of the camming surface closer to the second end of the camming surface than in the first position.

6. A dispenser as claimed in claim 1 wherein the first end of the bridge member engaging the lever at a location on the lever at a distance from the pivot axis equal to the constant radius.

7. A dispenser as claimed in claim 6 wherein (i) movement of the lever member pivotally about the pivot axis in a first rotational direction from the first rotational position towards the second rotational position slides the bridge member with its cammed faces in engagement with the camming surface moving the second end of the bridge member parallel to the linear portion of the camming surface and applying forces substantially merely parallel to the longitudinal axis to the slide element to move the slide element linearly to the extended position, and (ii) movement of the lever member pivotally about the pivot axis in a second rotational direction opposite to the first rotational direction from the second rotational position towards the first rotational position slides the bridge member with its cammed faces in engagement with the camming surface moving the second end of the bridge member parallel to the linear portion of the camming surface and applying forces substantially merely parallel to the longitudinal axis to the slide element to move the slide element linearly to the retracted position.

8. A dispenser as claimed in claim 1 wherein the camming surface comprises an outer camming surface directed toward the pivot axis and the cammed face comprises an inner cammed face directed away from the pivot axis for engagement with the outer camming surface.

9. A dispenser as claimed in claim 8 wherein the outer camming surface over the arcuate portion is concave as directed toward the pivot axis, and the outer cammed face assumes a corresponding convex shape directed away from the pivot axis where the outer cammed face engages the arcuate portion.

10. A dispenser as claimed in claim 8 wherein the camming surface further comprises an inner camming surface directed away from the pivot axis and the cammed face comprises an inner cammed face directed toward the pivot axis for engagement with the outer camming surface, the inner camming surface to engage the inner cammed face on the bridge member to assist in maintaining the outer cammed face in engagement with the outer camming surface, the inner camming surface disposed toward the pivot axis relative the outer camming surface, the bridge member being disposed between the outer camming surface and the inner camming surface.

11. A dispenser as claimed in claim 1 wherein the bridge member has an inherent bias to assume an inherent shape condition in which the cammed face is in a particular shape, the bridge member being resiliently deformable from its inherent shape condition have its cammed face assume different shape configurations corresponding to the shape of the camming surface with which the cammed face is in engagement.

12. A dispenser as claimed in claim 11 wherein in its inherent shape condition, the bridge member assumes an inherent flat condition in which the cammed face is flat and planar.

13. A dispenser as claimed in claim 11 wherein in its inherent shape condition, the bridge member assumes an inherent curved condition in which the cammed face is at a constant radius from the pivot axis corresponding to the camming surface over the curved portion.

14. A dispenser as claimed in claim 1 wherein the bridge member extends in a longitudinal direction between its first end and its second, the bridge extending in a transverse direction normal to the longitudinal direction between its first side edge and its second side edge, the cammed surface being disposed in a plane which in the transverse direction is parallel to the pivot axis.

15. A dispenser as claimed in claim 14 wherein the bridge member comprises a planar member having a first face and a second face bordered by the first end, second end, the first side edge and the second side edge, the cammed face comprising one or both of the first face and second face.

16. A dispenser as claimed in claim 15 wherein the planar member is not compressible or stretchable along its longitudinal direction or its transverse direction, the planar member is flexible in directions normal to its longitudinal direction and its transverse direction.

17. A dispenser comprising:

a housing, a dispensing mechanism including a slide element mounted for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having a pair of spaced first and second side walls on either side of the element, each side wall generally disposed in a plane normal to the pivot axis, each side wall having a slotway defined between an inner camming surface and an outer camming surface extending in the plane of its respective side wall from a first end of the slotway to a second end of the slotway, each slotway being parallel to the other slotway, each slotway having a constant width between the between the inner camming surface and the outer camming surface, each slotway having an arcuate portion and a linear portion, the arcuate portion extending from the first end to where it merges into the linear portion, the linear portion extending tangentially from the arcuate portion to the second end, in the arcuate portion the inner camming surface is disposed at a first radius from the pivot axis and the outer camming surface disposed at a second radius from the pivot axis greater than the first radius, in the linear portion the inner camming surface and the outer camming surface are straight and linear and each extends parallel to the longitudinal axis, the inner camming surface over the linear portion comprising a tangential extension of the inner camming surface where the arcuate portion merges with the linear portion, the inner camming surface over the linear portion being parallel to the longitudinal axis, the outer camming surface over the linear portion comprising a tangential extension of the outer camming surface where the arcuate portion merges with the linear portion, the outer camming surface over the linear portion being parallel to the longitudinal axis, a bridge member comprising a planar member having a first face, a second face, a first end, a second end, a first side edge and a second side edge, the bridge member spanning between the side walls of the housing with portions of the bridge member proximate the first side edge received in the slotway of the first side wall for longitudinal sliding in the slotway of the first side wall and with portions of the bridge member proximate the second side edge received in the slotway of the second side wall for longitudinal sliding in the slotway of the second side wall, the bridge member longitudinally slidable in each slotway between: (a) a first position in which the first end of the bridge member is in the arcuate portion of the slotways proximate the first end of the slotways and the second end of the bridge member is in the slotways spaced towards the second end of the slotways from the first end of the bridge member, and (b) a second position in which the second end of the bridge member is in the linear portion proximate the second end of the slotways and the first end of the bridge member is in the slotways spaced towards the first end of the slotways from the second end of the bridge member, in moving from the first position to the second position, flexible portions of the bridge member moving from being within the arcuate portions of the slotways to being within the linear portions of the slotway, and in moving from the second position to the first position, the flexible portions of the bridge member moving from being within the linear portions of the slotways to being within the arcuate portions of the slotway, the flexible portions of the bridge member conforming to the shape of the section of the slotway in which it is disposed in by engagement between the inner surfaces of the slotways with the first face the bridge member and/or by engagement between the outer surfaces of the slotways with the second face the bridge member, the first end of the bridge member engaging the lever at a location on the lever at a distance from the pivot axis at or between the first radius and the second radius, the second end of the bridge member engaging the slide element, wherein: (i) movement of the lever member pivotally about a pivot axis in a first rotational direction slides the first end of the bridge member in the arcuate portions of the slotway and slides the second end of the bridge member in the linear portion of the slotways applying forces substantially merely parallel to the longitudinal axis to the slide element to move the slide element linearly to a first of the extended position and the retracted position, and (ii) movement of the lever member pivotally about a pivot axis in a second rotational direction opposite to the first rotational direction slides the first end of the bridge member in the arcuate portions of the slotway and slides the second end of the bridge member in the linear portion of the slotways applying forces merely parallel to the longitudinal axis to the slide element to move the slide element linearly to the other of the extended position and the retracted position.

18. A dispenser as claimed in claim 17 wherein (a) in the first position in which the first end of the bridge member is in the arcuate portion of the slotways proximate the first end of the slotways, the second end of the bridge member is in the linear portion spaced from the second end of the slotways, and (b) in the second position in which the second end of the bridge member is in the linear portion proximate the second end of the slotways, the first end of the bridge member is in the arcuate portion of the slotways spaced farther from the first end of the slotways than in the first position.

19. A dispenser as claimed in claim 18 wherein the flexible portion of the bridge member comprises a planar sheet material which is flexible for deformation by forces applied normal to its faces but not compressible by forces applied to its ends normal to its faces at the ends.

20. A dispenser as claimed in claim 1 wherein the dispensing mechanism comprises a piston pump including a piston chamber forming member, the slide element comprising a piston coaxially reciprocally movable in a piston chamber forming member.

21. A dispenser comprising:

a housing, a dispensing Mechanism including a slide element mounted for cyclical reciprocal movement in a linear direction about a straight longitudinal axis relative the housing between an extended position and a retracted position to dispense a flowable material, a lever member pivotally mounted to the housing for pivotal movement about a pivot axis, the pivot axis substantially normal to the longitudinal axis, the housing having a pair of spaced first and second side walls on either side of the element, each side wall generally disposed in a plane normal to the pivot axis, each side wall having a slotway defined between an inner camming surface and an outer camming surface extending in the plane of its respective side wall from a first end of the slotway to a second end of the slotway, each slotway being parallel to the other slotway, each slotway having a constant width between the between the inner camming surface and the outer camming surface, each slotway having an arcuate portion, in the arcuate portion the inner camming surface is disposed at a first radius from the pivot axis and the outer camming surface disposed at a second radius from the pivot axis greater than the first radius, a bridge member comprising a planar member having a first face, a second face, a first end, a second end, a first side edge and a second side edge, the bridge member spanning between the side walls of the housing with portions of the bridge member proximate the first side edge received in the slotway of the first side wall for longitudinal sliding in the slotway of the first side wall and with portions of the bridge member proximate the second side edge received in the slotway of the second side wall for longitudinal sliding in the slotway of the second side wall, the bridge member longitudinally slidable in each slotway with the flexible portions of the bridge member conforming to the shape of the arcuate portion of the slotway in which it is disposed in by engagement between the inner surfaces of the slotways with the first face the bridge member and/or by engagement between the outer surfaces of the slotways with the second face the bridge member, the first end of the bridge member engaging the lever at a location on the lever at a distance from the pivot axis at or between the first radius and the second radius, the second end of the bridge member engaging the slide element, wherein: (i) movement of the lever member pivotally about a pivot axis in a first rotational direction slides the first end of the bridge member in the arcuate portions of the slotway and slides the second end of the bridge member to move the slide element linearly to a first of the extended position and the retracted position, and (ii) movement of the lever member pivotally about a pivot axis in a second rotational direction opposite to the first rotational direction slides the first end of the bridge member in the arcuate portions of the slotway and slides the second end of the bridge member to move the slide element linearly to the other of the extended position and the retracted position.

* * * * *